US006399564B1

(12) United States Patent
Speed et al.

(10) Patent No.: US 6,399,564 B1
(45) Date of Patent: Jun. 4, 2002

(54) DETERGENT TABLET

(75) Inventors: Lynda Anne Speed, Newcastle upon Tyne (GB); Jeffrey Donald Painter, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/555,081

(22) PCT Filed: Nov. 24, 1998

(86) PCT No.: PCT/US98/25074

§ 371 (c)(1),
(2), (4) Date: May 24, 2000

(87) PCT Pub. No.: WO99/27067

PCT Pub. Date: Jun. 3, 1999

Related U.S. Application Data

(60) Provisional application No. 60/066,093, filed on Nov. 26, 1997.

(51) Int. Cl.[7] ..... C11D 17/00; D06L 1/00

(52) U.S. Cl. ..... 510/446; 510/224; 510/294; 510/298; 510/330; 510/514; 510/515; 8/137

(58) Field of Search ..... 510/224, 294, 510/514, 515, 298, 330, 446; 8/137

(56) References Cited

U.S. PATENT DOCUMENTS

| | | | | | |
|---|---|---|---|---|---|
| 4,460,490 | A | | 7/1984 | Barfold et al. | 510/191 |
| 4,547,300 | A | * | 10/1985 | Laream | 252/8.8 |
| 4,828,749 | A | * | 5/1989 | Kruse et al. | 510/224 |
| 4,913,832 | A | * | 4/1990 | Kruse et al. | 510/224 |
| 5,133,892 | A | * | 7/1992 | Chung et al. | 510/224 |
| 5,972,870 | A | * | 10/1999 | Anderson | 510/298 |

FOREIGN PATENT DOCUMENTS

| | | | | |
|---|---|---|---|---|
| DE | 4315048 | A1 | * | 10/1994 |
| EP | 0224135 | A2 | * | 6/1987 |
| GB | 2327949 | A | * | 2/1999 |
| JP | 09087696 | A | * | 3/1997 |
| JP | 09175992 | A2 | * | 7/1997 |
| WO | 92/20774 | | * | 11/1992 |

* cited by examiner

*Primary Examiner*—Lorna M. Douyon
(74) *Attorney, Agent, or Firm*—Kevin L. Waugh; Brian Bolam

(57) ABSTRACT

A detergent tablet comprises a compressed portion and a non-compressed portion wherein the compressed portion comprises a mould and dissolves at a faster rate than the non-compressed portion on a weight by weight basis, measured using the SOTAX dissolution test method, and the non-compressed portion is at least partially retained within the mould.

14 Claims, No Drawings

DETERGENT TABLET

This application is a 371 of PCT/US 98/25074 filed Nov. 24, 1998 which claims benefit of Provisional application No. 60/066,903 filed Nov. 26, 1997.

TECHNICAL FIELD

The present invention relates to a detergent tablet comprising a compressed portion and a non-compressed portion wherein the compressed portion dissolves at a faster rate than the non-compressed portion and the non-compressed portion comprises a finishing additive.

BACKGROUND

Detergent compositions in tablet form are known in the art. It is understood that detergent compositions in tablet form hold several advantages over detergent compositions in particulate form, such as ease of handling, transportation and storage.

Detergent tablets are most commonly prepared by pre-mixing components of a detergent composition and forming the pre-mixed detergent components into a tablet using a tablet press. Tablets are typically formed by compression of the detergent components into a tablet. However, the Applicant has found that some components of a detergent composition are adversely affected by the compression pressure used to form the tablets. These components could not previously be included in a detergent tablet composition without sustaining a loss in performance. In some cases the components may even have become unstable or inactive as a result of the compression.

Furthermore as the components of the detergent composition are compressed, the components are brought into close proximity with each other. A result of the close proximity of the components can be that certain of the components react with each other, becoming unstable, inactive or exhausted. A solution to this problem, as seen in the prior art, has been to separate detergent components that may potentially react with each other, especially when the components are compressed into tablet form. Separation of the components has been achieved by, for example, preparing multiple-layer tablets wherein the components that may potentially react with each other are contained in different layers of the tablet. Multiple-layer tablets, are traditionally prepared using multiple compression steps. Layers of the tablet that are subjected to more than one compression step are subjected to a cumulative and potentially greater overall compression pressure. An increase in compression pressure is known to decrease the rate of dissolution of the tablet with the effect that the multiple layers may not dissolve satisfactorily in use.

Other methods of achieving separation of detergent components have been described. For example EP-A 0,224,135 describes a dishwashing detergent in a form which comprises a warm water-soluble melt, into which is pressed a cold water-soluble tablet. The document teaches a detergent composition that consists of two parts, the first part dissolving in the pre-rinse and the second part dissolving in the main wash of the dishwasher.

EP-B-0,055,100 describes a lavatory block formed by combining a slow dissolving shaped body with a tablet. The lavatory block is designed to be placed in the cistern of a lavatory and dissolves over a period of days, preferably weeks. As a means of controlling the dissolution of the lavatory block, the document teaches admixing one or more solubility control agents. Examples of such solubility control agents are paradichlorobenzene, waxes, long chain fatty acids and alcohols and esters thereof and fatty alkylamides.

The Applicant has found that by providing a detergent tablet comprising a compressed portion and a non-compressed portion detergent components previously considered to be unacceptable for detergent tablets, can be incorporated into a detergent tablet. In addition, potentially reactive components of the detergent composition can be effectively separated.

A further advantage of using a detergent tablet as described herein, is the performance benefits which may be achieved in being able to prepare a detergent tablet where the compressed portion has a faster rate of dissolution than the non-compressed portion

SUMMARY OF THE INVENTION

According to the present invention there is provided a detergent tablet comprising a compressed portion and a non-compressed portion wherein:

a) the compressed portion comprises a mould and dissolves at a faster rate than the non-compressed portion on a weight by weight basis, measured using the SOTAX dissolution test method described herein; and b) the non-compressed portion is at least partially retained with the mould.

In another aspect of the present invention there is provided a detergent tablet comprising a compressed portion and a non-compressed portion wherein the compressed portion dissolves at a faster rate than the non-compressed portion on a weight by weight basis, measured using the SOTAX dissolution test method described herein and wherein the density of the non-compressed portion is at least 0.2 g/cm$^3$ less than the density of the compressed portion.

In yet another aspect of the present invention there is provided a detergent tablet comprising a compressed portion and a non-compressed portion wherein:

a) the compressed portion dissolves at a faster rate than the non-compressed portion on a weight by weight basis, measured using the SOTAX dissolution test method described herein; and b) the non-compressed portion is metasilicate-free.

In yet another aspect of the present invention there is provided a detergent tablet comprising a compressed portion and a non-compressed portion wherein:

a) the compressed portion dissolves at a faster rate than the non-compressed portion on a weight by weight basis, measured using the SOTAX dissolution test method described herein; and b) the non-compressed portion comprises a finishing additive which is selected from the group consisting of organic polymeric compound, co-builder, enzyme, oxygen releasing bleach, bleach precursor or catalyst, surfactant, crystal growth inhibitor, bleach-destroying agent.

In yet another aspect of the present invention there is provided a detergent tablet comprising a compressed portion and a non-compressed portion wherein:

a) the compressed portion dissolves at a faster rate than the non-compressed portion on a weight by weight basis measured using the SOTAX dissolution test method described herein; and b) the non-compressed portion comprises a finishing additive which is a fabric softener or a rinse aid.

DETAILED DESCRIPTION OF THE INVENTION

The compressed portion of the present invention dissolves at a faster rate than the non-compressed portion on a weight by weight basis as measured by the Sotax dissolution test method outlined below. This difference in rate of dissolution means that components of the compressed and non-compressed portions can be delivered to the wash water at different points in the washing or rinsing cycle of the washing machine.

For the purposes of the present invention the compressed portion has a faster dissolution rate than the non-compressed portion meaning that the components of the compressed portion will be delivered to the wash water before the components of the non-compressed portion. In another aspect of the present invention, the non-compressed portion dissolves at a temperature of less than 30° C. The compressed portion of the detergent tablet will begin to dissolve immediately on contact with water. Preferably at least 60%, more preferably at least 80%, most preferably at least 95% of the compressed portion dissolves in deionised water at 50° C. within 12 minutes.

The non-compressed portion comprises at least one finishing additive as described later. Finishing additives are components that provide either a cleaning benefit e.g. enzyme, a soil anti-redeposition benefit e.g. organic polymeric compound or drainage benefit e.g. nonionic surfactant. The non-compressed portion also begins to dissolve on contact with water, although the slower dissolution rate of the non-compressed portion is such that less than 40%, preferably less than 20%, most preferably less than 10% or even 5% of the non-compressed portion dissolves in deionised water at 50° C. within 12 minutes.

In an alternative embodiment of the present invention the non-compressed portion dissolves in the rinsing cycle of the washing machine. In this embodiment the finishing additive can be either a fabric softener or a rinse aid. The fabric softener is delivered into the rinsing cycle of a laundry washing machine after the clothes have been washed and softens the fabric. The rinse aid is delivered into the rinsing cycle of the dishwashing and improves water drainage from the dishware and provides reduced spotting and filming benefits. In this embodiment of the present invention it is envisaged that the non-compressed portion does not begin to dissolve during the first 12 minutes of the washing cycle or that it begins to dissolve in the rinsing cycle.

Delayed dissolution of the non-compressed portion described in more detail later.

Compressed Portion

The compressed portion of the detergent tablet comprises at least one detergent component but preferably comprise a mixture of more than one detergent component, which are then compressed to form a tablet. Any detergent tablet component conventionally used in known detergent tablets is suitable for incorporation into the compressed portion of the detergent tablets of this invention. Suitable active detergent components are described hereinafter. Preferred active detergent components include builder compound, surfactant, bleaching agent, bleach activator, bleach catalyst, enzyme and an alkalinity source.

Detergent component(s) present in the compressed layer may optionally be prepared in combination with a carrier and/or a binder for example water, polymer (e.g. PEG), liquid silicate. The detergent components are preferably prepared in particulate form (i.e. powder or granular form) and may be prepared by any known method, for example conventional spray drying, granulation or agglomeration.

The particulate detergent component(s) are compressed using any equipment suitable for forming compressed tablets, blocks, bricks or briquettes; described in more detail hereafter.

In a preferred embodiment the compressed portions additionally comprise a disrupting agent. The disrupting agent may be a disintegrating or effervescing agent. Suitable disintegrating agents include agents that swell on contact with water or facilitated water influx and/or efflux by forming channels in compressed and/or non-compressed portions. Any known disintegrating or effervescing agent suitable for use in laundry or dishwashing applications is envisaged for use herein. Suitable disintegrating agent include starch, starch derivatives, alginates, carboxymethylcellulose (CMC), CMC-based polymers, sodium acetate, aluminium oxide. Suitable effervescing agents are those that produce a gas on contact with water. Suitable effervesing agents may be oxygen, nitrogen dioxide or carbon dioxide evolving species. Examples of preferred effervesing agents may be selected from the group consisting of perborate, percarbonate, carbonate, bicarbonate and carboxylic acids such as citric or maleic acid.

The density of the compressed portion is generally in the range of from 1.3 g/cm$^3$ to 1.9 g/cm$^3$, more preferably from 1.4 g/cm$^3$ to 1.8 g/cm$^3$, most preferably from 1.4 g/cm$^3$ to 1.7 g/cm$^3$.

Density is calculated by dividing the weight (mass) of the compressed portion by the volume of the compressed portion. The volume is calculated by multiplying the length by the width by the breadth of the compressed portion.

Non-Compressed Portion

The non-compressed comprises a finishing additive but may also comprise one or more detergent components. Detergent components suitable for incorporation in the non-compressed portion include components that interact with one or more detergent components present in the compressed portion. Where further detergent components are present in the non-compressed portion, preferred components include those that that are adversely affected by compression pressure of, for example a compression tablet press. Examples of such detergent components include, but are not limited to, enzyme, corrosion inhibitor and perfume. These components are described in more detail below.

The finishing additives and optional detergent component (s) may be in any form for example particulate (i.e. powder or granular), gel or liquid form. The non-compressed portion may also optionally comprise a carrier component. The detergent component may be present in the form of a solid, gel or liquid, prior to combination with a carrier component.

The non-compressed portion of the detergent tablet may be in solid, gel or liquid form.

The detergent tablet of the present invention requires that the non-compressed portion be delivered to the compressed portion such that the compressed portion and non-compressed portion contact each other. The non-compressed portion may be delivered to the compressed portion in solid or flowable form. Where the non-compressed portion is in solid form, it is pre-prepared, optionally shaped and then delivered to the compressed portion. The non-compressed portion is then affixed to a pre-formed compressed portion, for example by adhesion or by insertion of the non-compressed portion to a co-operating surface of the compressed portion. Preferably the compressed portion comprises a pre-prepared depression or mould into which the non-compressed portion is delivered.

The non-compressed portion is preferably delivered to the compressed portion in flowable form. The non-compressed portion is then affixed to the compressed portion for example by adhesion, by forming a coating over the non-compressed layer to secure it to the compressed portion, or by hardening, for example (i) by cooling to below the melting point where the flowable composition becomes a solidified melt; (ii) by evaporation of a solvent; (iii) by crystallisation; (iv) by polymerisation of a polymeric component of the flowable non-compressed portion; (v) through pseudo-plastic properties where the flowable non-compressed portion comprises a polymer and shear forces are applied to the non-compressed portion; (vi) combining a binding agent with the flowable non-compressed portion. In an alternative embodiment the flowable non-compressed portion may be an extrudate that is affixed to the compressed portion by for example any of the mechanism described above or by expansion of the extrudate to the parameters of a mould provided by the compressed portion.

Preferably the compressed portion comprises a pre-prepared depression or mould (hereafter referred to as 'mould') into which the non-compressed portion is delivered. In an alternative embodiment the surface of the compressed portion comprises more than one mould into which the non-compressed portion may be delivered. The mould(s) preferably at least partially accommodates one or more non-compressed portions. The non-compressed portion(s) is then delivered into the mould and affixed to the compressed portion as described above.

The non-compressed portion may comprise particulates. The particulates may be prepared by any known method, for example conventional spray drying, granulation, encapsulation or agglomeration. Particulates may be affixed to the compressed portion by incorporating a binding agent or by forming a coating layer over the non-compressed portion.

Where the non-compressed portion comprises a solidified melt, the melt is prepared by heating a composition comprising the finishing additive and any optional detergent and/or carrier component(s) to above its melting point to form a flowable melt. The flowable melt is then poured into a mould and allowed to cool. As the melt cools it becomes solid, taking the shape of the mould at ambient temperature. Where the composition comprises one or more carrier components, the carrier component(s) may be heated to above their melting point, and then an active detergent component may be added. Carrier components suitable for preparing a solidified melt are typically non-active components that can be heated to above melting point to form a liquid and cooled to form an intermolecular matrix that can effectively trap the finishing additive and optional detergent components. A preferred carrier component is an organic polymer that is solid at ambient temperature. Preferably the carrier component is polyethylene glycol (PEG). The compressed portion of the detergent tablet preferably provides a mould to accommodate the melt.

The flowable non-compressed portion may be in a form comprising a dissolved or suspended finishing additive and optional detergent component. The flowable non-compressed portion may harden over time to form a solid, semi solid or highly viscous liquid by any of the methods described above. In particular, the flowable non-compressed portion may harden by evaporation of a solvent. Solvents suitable for use herein may include any known solvent in which a binding or gelling agent is soluble. Preferred solvents may be polar, non-polar, non-aqueous or anhydrous and may include for example water, glycerine, alcohol, (for example ethanol, acetone) and alcohol derivatives. In an alternative embodiment more than one solvent may be used.

The flowable non-compressed portion may comprise one or more binding or gelling agents. Any binding or gelling agent that has the effect of causing the composition to become solid, semi-solid or highly viscous over time is envisaged for use herein. Although not wishing to be bound by theory, it is believed that mechanisms by which the binding or gelling agent causes a non-solid composition to become solid, semi-solid or highly viscous include: chemical reaction (such as chemical cross linking), or effect interaction between two or more components of the flowable compositions either; chemical or physical interaction of the binding agent with a component of the composition.

In a preferred aspect of the present invention the non-compressed portion comprises a gel. In this aspect the gel is delivered to the compressed portion of the detergent tablet, but is preferably delivered into a mould provided by the compressed portion.

The gel comprises a thickening system in addition to the finishing additive and other optional detergent components. In addition the gel may also comprise solid ingredients to aid in the control of the viscosity of the gel in conjunction with the thickening system. Solid ingredients may also act to optionally disrupt the gel thereby aiding dissolution of the gel. When included, the gel portion typically comprises at least 15% solid ingredients, more preferably at least 30% solid ingredients and most preferably at least 40% solid ingredients. However, due to the need to be able to pump and otherwise process the gel, the gel typically does not include more than 90% solid ingredients.

As noted earlier, the gel comprises a thickening system to provide the required viscosity or thickness of the gel. The thickening system typically comprises a non-aqueous liquid diluent and an organic or polymeric gelling additive:

a) Liquid Diluent: the term "solvent" or "diluent" is used herein to connote the liquid portion of the thickening system. While some of the components of the non-compressed portion may actually dissolve in the "solvent"-containing phase, other components may be present as particulate material dispersed within the "solvent"-containing phase. Thus the term "solvent" is not meant to require that the components of the non-compressed portion be capable of actually dissolving in the solvent. Suitable types of solvents useful in the non-aqueous thickening systems herein include alkylene glycol mono lower alkyl ethers, propylene glycols, ethoxylated or propoxylated ethylene or propylene, glycerol esters, glycerol triacetate, lower molecular weight polyethylene glycols, lower molecular weight methyl esters and amides.

A preferred type of non-aqueous solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropylene glycol monoethyl ether, and dipropylene glycol monobutyl ether. Diethylene glycol mono butyl ether and dipropylene glycol monobutyl ether are especially preferred. Compounds of the type have been commercially marketed under the tradenames Dowanol, Carbitol, and Cellosolve.

Another preferred type of non-aqueous solvent useful herein comprises the lower molecular weight polyethylene glycols (PEGs). Such materials are those having molecular weights of at least 150. PEGs of molecular weight ranging from 200 to 600 are most preferred.

Yet another preferred type of non-aqueous solvent comprises lower molecular weight methyl esters. Such materials are those of the general formula: $R^1$—C(O)—$OCH_3$ wherein $R^1$ ranges from 1 to 18. Examples of suitable lower molecular weight methyl esters include methyl acetate, methyl propionate, methyl octanoate, and methyl dodecanoate.

The non-aqueous organic solvent(s) employed should, of course, be compatible and non-reactive with the finishing additive and other optional detergent components, e.g. enzymes. Such a solvent component will generally be utilized in an amount of from 10% to 60% by weight of the gel portion. More preferably, the non-aqueous, low-polarity organic solvent will comprise from 20% to 50% by weight of the gel portion, most preferably from 30% to 50% by weight of the gel portion.

b) Gelling Additive: a gelling agent or additive is added to the non aqueous solvent of the present invention to complete the thickening system. To form the gel required for suitable phase stability and acceptable rheology of the gel, the organic gelling agent is generally present to the extent of a ratio of solvent to gelling agent in thickening system typically ranging from 99:1 to 1:1. More preferably, the ratios range from 19:1 to 4:1.

The preferred gelling agents of the present invention are selected from castor oil derivatives, polyethylene glycol, sorbitols and related organic thixatropes, organoclays, cellulose and cellulose derivatives, pluronics, stearates and stearate derivatives, sugar/gelatin combination, starches, glycerol and derivatives thereof, organic acid amides such as N-lauryl-L-glutamic acid di-n-butyl amide, polyvinyl pyrrolidone and mixtures thereof.

The preferred gelling agents include castor oil derivatives. Castor oil is a naturally occurring triglyceride obtained from the seeds of *Ricinus communis*, a plant which grows in most tropical or subtropical areas. The primary fatty acid moiety in the castor oil triglyceride is ricinoleic acid (12-hydroxy oleic acid). It accounts for 90% of the fatty acid moieties. The balance consists of dihydroxystearic, palmitic, stearic, oleic, linoleic, linolenic and eicosanoic moieties. Hydrogenation of the oil (e.g., by hydrogen under pressure) converts the double bonds in the fatty acid moieties to single bonds, thus "hardening" the oil. The hydroxyl groups are unaffected by this reaction.

The resulting hydrogenated castor oil, therefore, has an average of about three hydroxyl groups per molecule. It is believed that the presence of these hydroxyl groups accounts in large part for the outstanding structuring properties which are imparted to the gel portion compared to similar liquid detergent compositions which do not contain castor oil with hydroxyl groups in their fatty acid chains. For use in the compositions of the present invention the castor oil should be hydrogenated to an iodine value of less than 20, and preferably less than 10. Iodine value is a measure of the degree of unsaturation of the oil and is measured by the "Wijis Method," which is well-known in the art. Unhydrogenated castor oil has an iodine value of from 80 to 90.

Hydrogenated castor oil is a commercially available commodity being sold, for example, in various grades under the trademark CASTORWAX.RTM. by NL Industries, Inc., Highstown, N.J. Other Suitable hydrogenated castor oil derivatives are Thixcin R, Thixcin E, Thixatrol ST, Perchem R and Perchem ST, made by Rheox, Laporte. Especially preferred is Thixatrol ST.

Polyethylene glycols when employed as gelling agents, rather than solvents, are low molecular weight materials, having a molecular weight range of from 1000 to 10,000, with 3,000 to 8,000 being the most preferred.

Cellulose and cellulose derivatives when employed in the present invention preferably include: i) Cellulose acetate and Cellulose acetate phthalate (CAP); ii) Hydroxypropyl Methyl Cellulose (HPMC); iii) Carboxy methylcellulose (CMC); and mixtures thereof. The hydroxypropyl methylcellulose polymer preferably has a number average molecular weight of 50,000 to 125,000 and a viscosity of a 2 wt. % aqueous solution at 25° C. (ADTMD2363) of 50,000 to 100,000 cps. An especially preferred hydroxypropyl cellulose polymer is Methocel® J75MS-N wherein a 2.0 wt. % aqueous solution at 25° C. has a viscosity of about 75,000 cps.

The sugar may be any monosaccharide (e.g. glucose), disaccharide (e.g. sucrose or maltose) or polysaccharide. The most preferred sugar is commonly available sucrose. For the purposes of the present invention type A or B gelatin may be used, available from for example Sigma. Type A gelatin is preferred since it has greater stability in alkaline conditions in comparison to type B. Preferred gelatin also has a bloom strength of between 65 and 300, most preferably between 75 and 100.

The gel may include a variety of other ingredients in addition to the thickening agent as herein before described and the finishing additive described in more detail below. Ingredients such as dyes may be included as well as structure modifying agents. Structure modifying agents include various polymers and mixtures of polymers included polycarboxylates, carboxymethylcelluloses and starches to aid in adsorption of excess solvent and/or reduce or prevent "bleeding" or leaking of the solvent from the gel portion, reduce shrinkage or cracking of the gel portion or aid in the dissolution or breakup of the gel portion in the wash. In addition, hardness modifying agents may incorporated into the thickening system to adjust the hardness of the gel if desired. These hardness control agents are typically selected from various polymers, such as polyethylene glycol's, polyethylene oxide, polyvinylpyrrolidone, polyvinyl alcohol, hydroxystearic acid and polyacetic acid and when included are typically employed in levels of less than 20% and more preferably less than 10% by weight of the solvent in the thickening system.

The gel is formulated so that it is a pumpable, flowable gel at slightly elevated temperatures of around 30° C. or greater to allow increased flexibility in producing the detergent tablet, but becomes highly viscous or hardens at ambient temperatures so that the gel is maintained in position on the compressed portion of the detergent tablet through shipping and handling of the detergent tablet. Such hardening of the gel may achieved, for example, by (i) cooling to below the flowable temperature of the gel or the removal of shear; (ii) by solvent transfer, for example either to the atmosphere of the compressed body portion; or by (iii) by polymerisation of the gelling agent. Preferably, the gel is formulated such that it hardens sufficiently so that the maximum force needed to push a probe into the non-compressed portion preferably ranges from 0.5N to 40N. This force may be characterised by measuring the maximum force needed to push a probe, fitted with a strain gauge, a set distance into the gel. The set distance may be between 40% and 80% of the total gel depth. This force can be measured on a QTS 25 tester, using a probe of 5 mm diameter. Typical forces measured are in the range of 1N to 25N.

Where the non-compressed portion is an extrudate, the extrudate is prepared by premixing detergent components of the non-compressed portion with optional carrier components to form a viscous paste. The viscous paste is then extruded using any suitable commonly available extrusion equipment such as for example a single or twin screw extruder available from for example APV Baker, Peterborough, U.K. The extrudate is then cut to size either after delivery to the compressed portion, or prior to delivery to the compressed portion of the detergent tablet. The compressed portion of the tablet preferably comprises a mould into which the extruded non-compressed portion may be delivered.

In a preferred embodiment the non-compressed portion is coated with a coating layer. The coating may be used to affix a non-compressed portion to the compressed portion. This may be particularly advantageous where the non-compressed portion comprises flowable particulates, gels or liquids.

The coating layer preferably comprises a material that becomes solid on contacting the compressed and/or the non-compressed portions within preferably less than 15 minutes, more preferably less than 10 minutes, even more preferably less than 5 minutes, most preferably less than 60 seconds. Preferably the coating layer is water-soluble. Preferred coating layers comprise materials selected from the group consisting of fatty acids, alcohols, diols, esters and ethers, adipic acid, carboxylic acid, dicarboxylic acid, polyvinyl acetate (PVA), polyvinyl pyrrolidone (PVP), polyacetic acid (PLA), polyethylene glycol (PEG) and mixtures thereof. Preferred carboxylic or dicarboxylic acids preferably comprise an even number of carbon atoms. Preferably carboxylic or dicarboxylic acids comprise at least 4, more preferably at least 6, even more preferably at least 8 carbon atoms, most preferably between 8 and 13 carbon atoms. Preferred dicarboxylic acids include adipic acid, suberic acid, azelaic acid, subacic acid, undecanedioic acid, dodecandioic acid, tridecanedioic and mixtures thereof Preferred fatty acids are those having a carbon chain length of from C12 to C22, most preferably from C18 to C22. The coating layer may also preferably comprise a disrupting agent. Where present the coating layer generally present at a level of at least 0.05%, preferably at least 0.1%, more preferably at least 1%, most preferably at least 2% or even at least 5% of the detergent tablet.

As an alternative embodiment the coating layer may encapsulate the detergent tablet. In this embodiment the coating layer is present at a level of at least 4%, more preferably at least 5%, most preferably at least 10% of the detergent tablet.

The density of the non-compressed portion is generally from 0.7 g/cm$^3$ to 1.2 g/cm$^3$, more preferably from 0.8 g/cm$^3$ to 1.2 g/cm$^3$, most preferably from 0.9 g/cm$^3$ to 1.1 g/cm$^3$. The density of the non-compressed portion is preferably at least 0.2 g/cm$^3$, more preferably at least 0.3 g/cm$^3$, most preferably at least 0.4 g/cm$^3$ less than the density of the compressed portion.

Density Measurement of the non-compressed portion: Preferably the density of the non-compressed portion is measured using a simple funnel and cup device consisting of a conical funnel moulded rigidly on a base and provided with a flap valve at its lower extremity to allow the contents of the funnel to be emptied into an axially aligned cylindrical cup of known volume disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

A density measurement is taken by hand pouring the non-compressed into the funnel. Once the funnel is filled, the flap valve is opened and powder allowed to run through the funnel, overfilling the cup. The filled cup is removed from the frame and excess non-compressed portion removed from the cup by passing a straight edged implement e.g. a knife, across its upper edge. The filled cup is then weighed. The weight of the non-compressed portion is calculated by subtracting the weight of the cup from the weight of the cup plus the non-compressed portion. Density is then calculated by dividing the weight (mass) of the non-compressed portion by the volume of the cup. Replicate measurements are made as required.

The detergent tablet of the present invention is manufactured in according to a process described herein.

Delayed Dissolution of the Non-compressed Portion

Delayed dissolution of the non-compressed portion may be achieved by, for example selecting particulate detergent components for use as components of the non-compressed portion that are encapsulated with a component which is slow dissolving or partially soluble in water. Such encapsulating materials include cellulose and cellulose derivatives e.g. cellulose acetate, cellulose acetate phthalate (CAP), hydroxypropyl Methyl Cellulose (HPMC), carboxymethylcellulose (CMC) and mixtures thereof. The hydroxypropyl methylcellulose polymer preferably has a number average molecular weight of 50,000 to 200,000 and a viscosity of a 2 wt. % aqueous solution at 25° C. (ADTMD2363) of 50,000 to 120,000 cps. An especially preferred hydroxypropyl cellulose polymer is Methocel® J75MS-N wherein a 2.0 wt. % aqueous solution at 25° C. has a viscosity of about 75,000 cps. Other preferred encapsulating materials include gelatine of bloom strength in the range of from 30 to 200, preferably from 75 to 200.

The thickness of the encapsulating material will determine the dissolution rate of the encapsulated detergent component and thus the delivery rate of the detergent component to the wash water. The encapsulated detergent components are then delivered to the compressed portion or are preferably suspended in a matrix of liquid or preferably gel that is delivered to the compressed portion. The non-compressed portion is adhered to the compressed portion by the methods described above.

Another example of a means by which the dissolution of the non-compressed portion may be delayed is premixing detergent components in a matrix which is slow dissolving or partially soluble in water. A particularly preferred matrix is a gel or viscous liquid as described above. The gel matrix preferably comprises organic or inorganic polymers. Preferred polymers include polyethylene glycol of molecular weight from 1,000 to 20,000, more preferably from 4,000 to 10,000 or even 12,000.

Yet another example of a means by which the dissolution of the non-compressed portion may be delayed is preparing a non-compressed portion as described above, then delivering the non-compressed portion to the compressed portion and coating the non-compressed portion with a coating layer as described above.

In yet another example the non-compressed portion is such that it comprises at least one component which react with an outside stimulus, such as temperature or pH, to initiate dissolution. An example of a component that would initiate dissolution on reaction to a change in temperature is a wax. In particular it is envisaged that a suitable wax will have a melting temperature above room temperature, preferably above 40° C., most preferably above 50° C.

SOTAX Dissolution Test Method: The SOTAX machine consists of a temperature controlled waterbath with lid. 7 pots are suspended in the water bath. 7 electric stirring rods are suspended from the underside of the lid, in positions corresponding to the position of the pots in the waterbath. The lid of the waterbath also serves as a lid on the pots.

The SOTAX waterbath is filled with water and the temperature gauge set to 50° C. Each pot is then filled with 1 liter of deionised water and the stirrer set to revolve at 250 rpm. The lid of the waterbath is closed, allowing the temperature of the deionised water in the pots to equilibrate with the water in the waterbath for 1 hour.

Equal weight of the compressed and non-compressed portions are weighed out. The compressed portion is placed in a first pot and the non-compressed portion is placed in a second pot. The lid is then closed. The compressed and non-compressed portions are visually monitored until they completely dissolves. The time is noted when the compressed portion and the non-compressed portions have completely dissolved. The dissolution rate of the compressed portion or non-compressed portion is calculated as the average weight (g) of each portion dissolved in deionised water per minute.

Finishing Additive

The non-compressed portion of the present invention comprises a finishing additive. By the term finishing additive it is meant an additive which is released into the latter stages of the washing cycle or into the rinsing cycle of a laundry washing or dishwashing machine.

Finishing additives suitable for use herein are selected from the group consisting of organic polymeric compound, enzymes, perfume component, oxygen releasing bleaching agent, precursor or catalyst, bleach destroying agent, co-builder, crystal growth inhibitor, surfactant, cationic fabric softening agent and a rinse aid.

Bleaching Agent

Suitable bleaching agents for incorporation into the compressed portion include both oxygen releasing and chlorine bleaching agents. Bleaching agents suitable for use as finishing additive are oxygen-releasing bleaching agents.

The oxygen-releasing bleaching agent contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. In an alternative preferred aspect a preformed organic peroxyacid is incorporated directly into the composition. Compositions containing mixtures of a hydrogen peroxide source and organic peroxyacid precursor in combination with a preformed organic peroxyacid are also envisaged.

Inorganic Perhydrate Bleaches

The oxygen-releasing bleach preferably is a hydrogen peroxide source. Suitable hydrogen peroxide sources include the inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for inclusion in compositions in accordance with the invention. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise. The percarbonate is most preferably incorporated into such compositions in a coated form which provides in-product stability.

A suitable coating material providing in product stability comprises mixed salt of a water soluble alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5.

Another suitable coating material providing in product stability, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility in the compositions herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

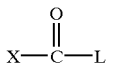

where L is a leaving group and X is essentially any functionality, such that on perhydrolysis the structure of the peroxyacid produced is

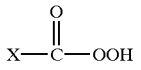

Peroxyacid bleach precursor compounds are preferably incorporated at a level of from 0.5% to 20% by weight, more preferably from 1% to 10% by weight, most preferably from 1.5% to 5% by weight of the compositions.

Suitable peroxyacid bleach precursor compounds typically contain one or more N- or O-acyl groups, which precursors can be selected from a wide range of classes.

Suitable classes include anhydrides, esters, imides, lactams and acylated derivatives of imidazoles and oximes. Examples of useful materials within these classes are disclosed in GB-A-1596789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching composition.

Preferred L groups are selected from the group consisting of:

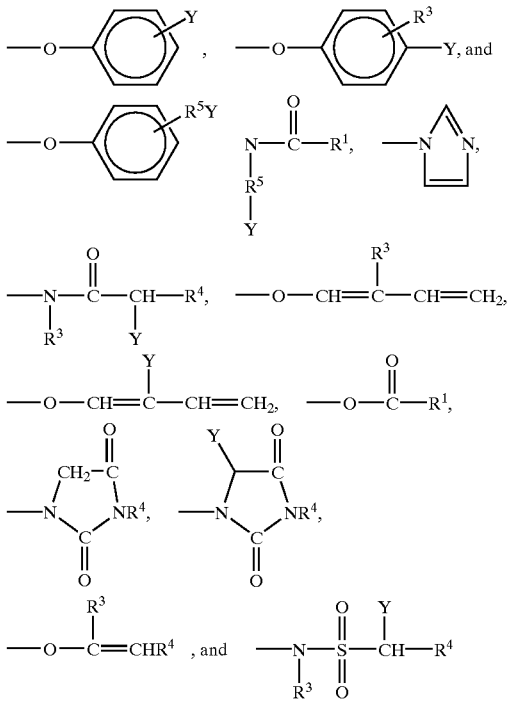

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, $R^5$ is an alkenyl chain containing from 1 to 8 carbon atoms and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

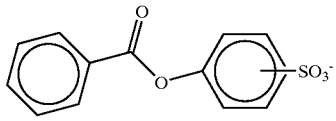

Also suitable are the benzoylation products of sorbitol, glucose, and all saccharides with benzoylating agents, including for example:

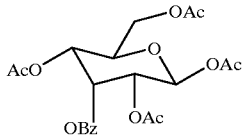

Ac=COCH3; Bz=Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

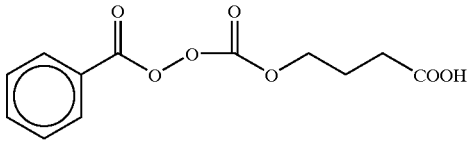

Phthalic anhydride is another suitable perbenzoic acid precursor compound herein:

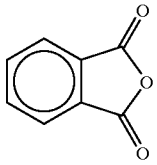

Suitable N-acylated lactam perbenzoic acid precursors have the formula:

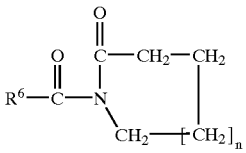

wherein n is from 0 to 8, preferably from 0 to 2, and $R^6$ is a benzoyl group.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e.; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

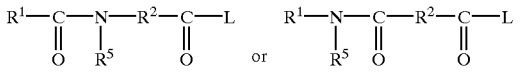

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Neroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium)methyl derivative of benzoyl oxybenzene sulfonate:

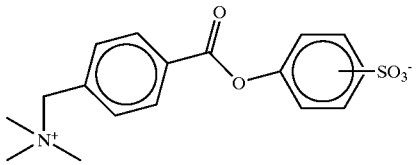

A preferred cationically substituted alkyl oxybenzene sulfonate has the formula:

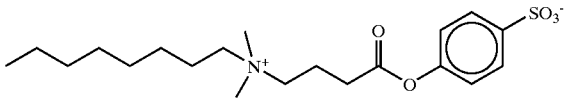

Preferred cationic peroxyacid precursors of the N-acylated caprolactam class include the trialkyl ammonium methylene benzoyl caprolactams, particularly trimethyl ammonium methylene benzoyl caprolactam:

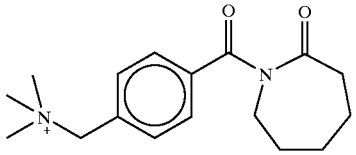

Other preferred cationic peroxyacid precursors of the N-acylated caprolactam class include the trialkyl ammonium methylene alkyl caprolactams:

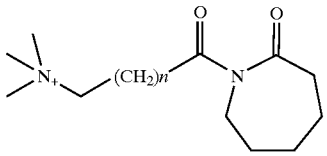

where n is from 0 to 12, particularly from 1 to 5.

Another preferred cationic peroxyacid precursor is 2-(N,N,N-trimethyl ammonium)ethyl sodium 4-sulphophenyl carbonate chloride.

Alkyl Percarboxylic Acid Bleach Precursors

Alkyl percarboxylic acid bleach precursors form percarboxylic acids on perhydrolysis.

Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide Substituted Alkyl Peroxyacid Precursors

Amide substituted alkyl peroxyacid precursor compounds are also suitable, including those of the following general formulae:

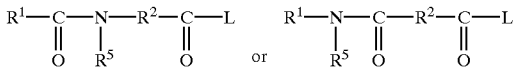

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^4$ and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A-482,807, particularly those having the formula:

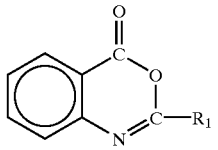

including the substituted benzoxazins of the type

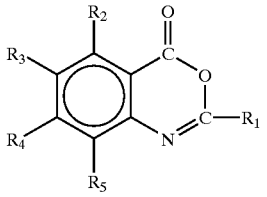

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

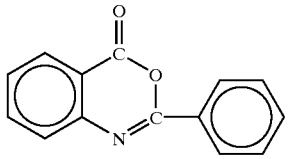

Preformed Organic Peroxyacid

The organic peroxyacid bleaching system may contain, in addition to, or as an alternative to, an organic peroxyacid bleach precursor compound, a preformed organic peroxyacid, typically at a level of from 0.5% to 25% by weight, more preferably from 1% to 10% by weight of the composition.

A preferred class of organic peroxyacid compounds are the amide substituted compounds of the following general formulae:

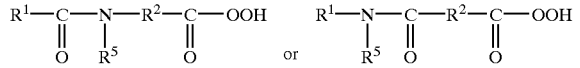

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-01 70386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Metal-containing Bleach Catalyst

Where the compressed portion or the non-compressed portion of the present invention contain an oxygen-releasing bleaching agent, a preferred additional component is a metal containing bleach catalyst. Preferably the metal containing bleach catalyst is a transition metal containing bleach catalyst, more preferably a manganese or cobalt-containing bleach catalyst.

A suitable type of bleach catalyst is a catalyst comprising a heavy metal cation of defined bleach catalytic activity, such as copper, iron cations. an auxiliary metal cation having little or no bleach catalytic activity, such as zinc or aluminium cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Preferred types of bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3(1,4,7\text{-trimethyl-}1,4,7\text{-triazacyclononane})_2\text{-}(PF_6)_2$, $Mn^{III}_2(u\text{-}O)_1(u\text{-}OAc)_2(1,4,7\text{-trimethyl-}1,4,7\text{-triazacyclononane})_2\text{-}(ClO_4)_2$, $Mn^{IV}_4(u\text{-}O)_6(1,4,7\text{-triazacyclononane})_4\text{-}(ClO_4)_2$, $Mn^{III}Mn^{IV}_4(u\text{-}O)_1(u\text{-}OAc)_2\text{-}(1,4,7\text{-trimethyl-}1,4,7\text{-triazacyclononane})_2\text{-}(ClO_4)_3$, and mixtures thereof Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful in the compositions herein may also be selected as appropriate for the present invention.

For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

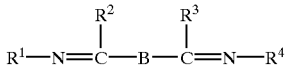

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe, -bispyridylmethane and -bispyridylamine complexes. Highly preferred catalysts include Co(2,2'-bispyridylamine)$Cl_2$, Di(isothiocyanato) bispyridylamine-cobalt(II), trisdipyridylamine-cobalt(II) perchlorate, Co(2,2-bispyridylamine)$_2O_2ClO_4$, Bis-(2,2'-bispyridylamine)copper(II)perchlorate, tris(di-2-pyridylamine)iron(II)perchlorate, and mixtures thereof.

Preferred examples include binuclear Mn complexes with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$—$(ClO_4)_3$.

While the structures of the bleach-catalyzing manganese complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn-ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt co-builder catalyst) Canadian 866,191 (transition metal-containing salts), U.S. Pat. No. 4,430,243 (co-builders with manganese cations and non-catalytic metal cations), and U.S. Pat. No. 4,728,455 (manganese gluconate catalysts).

Other preferred examples include cobalt(III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining co-ordination sites stabilise the cobalt under automatic dishwashing conditions such that the reduction potential for cobalt(III) to cobalt(II) under alkaline conditions is less than 0.4 volts (preferably less than 0.2 volts) versus a normal hydrogen electrode.

Preferred cobalt catalysts of this type have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention compositions which utilize cobalt(III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, $HOC(O)CH_2C(O)O$—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'_4{}^+$, wherein n is an integer from 1 to 16, preferably from 2 to 10, and most preferably from 2 to 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$ ($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in the Tobe article hereinbefore and the references cited therein, in U.S. Pat. No. 4,810,410, to Diakun et al, issued Mar. 7, 1989, *J. Chem. Ed.* (1989), 66 (12), 104345; The Synthesis and Characterization of Inorganic Compounds, W. L. Jolly (Prentice-Hall; 1970), pp. 461–3; *Inorg. Chem.*, 18, 1497–1502 (1979); *Inorg. Chem.*, 21, 2881–2885 (1982); *Inorg. Chem.*, 18, 2023–2025 (1979); Inorg. Synthesis, 173–176 (1960); and *Journal of Physical Chemistry*, 56, 22–25 (1952); as well as the synthesis examples provided hereinafter.

Cobalt catalysts suitable for incorporation into the detergent tablets of the present invention may be produced according to the synthetic routes disclosed in U.S. Pat. Nos. 5,559,261, 5,581,005, and 5,597,936, the disclosures of which are herein incorporated by reference.

These catalysts may be co-processed with adjunct materials so as to reduce the colour impact if desired for the aesthetics of the product, or to be included in enzyme-containing particles as exemplified hereinafter, or the compositions may be manufactured to contain catalyst "speckles".

Enzymes

Suitable enzymes for incorporation into the compressed portion or the non-compressed portion as a finishing additive, are selected from the group consisting of cellulases, hemicellulases, peroxidases, proteases, glucoamylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

Preferred enzymes include protease, amylase, lipase, peroxidases, cutinase and/or cellulase in conjunction with one or more plant cell wall degrading enzymes.

The cellulases usable in the present invention include both bacterial or fungal cellulase. Preferably, they will have a pH optimum of between 5 and 12 and an activity above 50 CEVU (Cellulose Viscosity Unit). Suitable cellulases are disclosed in U.S. Pat. No. 4,435,307, Barbesgoard et al, J61078384 and WO96/02653 which disclose fungal cellulases produced respectively from Humicola insolens, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of Humicola insolens (*Humicola grisea* var. *thermoidea*), particularly the Humicola strain DSM 1800. Other suitable cellulases are cellulases originated from Humicola insolens having a molecular weight of 50 KDa, an isoelectric point of 5.5 and containing 415 amino acids; and a ~43 kD endoglucanase derived from Humicola insolens, DSM 1800, exhibiting cellulase activity; a preferred endoglucanase component has the amino acid sequence disclosed in PCT Patent Application No. WO 91/17243. Also suitable cellulases are the EGIII cellulases from *Trichoderma longibrachiatum* described in WO94/21801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471.

Said cellulases are normally incorporated in the detergent composition at levels from 0.0001% to 2% of active enzyme by weight of the detergent composition.

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Peroxidase-containing detergent compositions are disclosed, for example, in PCT International Application WO 89/099813, WO89/09813 and in European Patent application EP No. 91202882.6, filed on Nov. 6, 1991, now EP 540 784. Also suitable is the laccase enzyme.

Preferred enhancers are substitued phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substitued syringates (C3–C5 substitued alkyl syringates) and phenols. Sodium percarbonate or perborate are preferred sources of hydrogen peroxide.

Said cellulases and/or peroxidases are normally incorporated in the detergent composition at levels from 0.0001% to 2% of active enzyme by weight of the detergent composition.

Other preferred enzymes that can be included in the detergent compositions of the present invention include lipases. Suitable lipase enzymes for detergent usage include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1 Lipase® and Lipomax® (Gist-Brocades) and Lipolase® and Lipolase Ultra®(Novo) which have found to be very effective when used in combination with the compositions of the present invention. Also suitables are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor); WO 90/09446 (Plant Genetic System) and WO 94/14963 and WO 94/14964 (Unilever).

The lipases and/or cutinases are normally incorporated in the detergent composition at levels from 0.0001% to 2% of active enzyme by weight of the detergent composition.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® (by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is what is called herein "Protease C", which is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO95/10591 and in the patent application of C. Ghosh, et al, "Bleaching Compositions Comprising Protease Enzymes" having U.S. Ser. No. 08/322,677, filed Oct. 13, 1994 now U.S. Pat No. 5,677,272.

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Other preferred protease enzymes include protease enzymes which are a carbonyl hydrolase variant having an amino acid sequence not found in nature, which is derived by replacement of a plurality of amino acid residues of a precursor carbonyl hydrolase with different amino acids, wherein said plurality of amino acid residues replaced in the precursor enzyme correspond to position +210 in combination with one or more of the following residues: +33, +62, +67, +76, +100, +101, 30 103, +104, +107, +128, +129, +130, +132, +135, +156, +158, +164, +166, +167, +170, +209, +215, +217, +218 and +222, where the numbered positions correspond to naturally-occurring subtilisin from *Bacillus amyloliquefaciens* or to equivalent amino acid residues in other carbonyl hydrolases or subtilisins (such as *Bacillus lentus* subtilisin). Preferred enzymes of this type include those having position changes +210, +76, +103, +104, +156, and +166.

The proteolytic enzymes are incorporated in the detergent compositions of the present invention a level of from 0.0001% to 2%, preferably from 0.001% to 0.2%, more preferably from 0.005% to 0.1% pure enzyme by weight of the composition. Amylases (α and/or β) can be included for removal of carbohydrate-based stains. WO94/02597, Novo Nordisk A/S published Feb. 03, 1994, describes cleaning compositions which incorporate mutant amylases. See also WO95/10603, Novo Nordisk A/S, published Apr. 20, 1995. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314, published Aug. 18, 1994 and WO96/05295, Genencor, published Feb. 22, 1996 and amylase variants having additional modification in the immediate parent available from Novo Nordisk A/S, disclosed in WO 95/10603, published April 1995. Also suitable are amylases described in EP 277 216, WO95/26397 and WO96/23873 (all by Novo Nordisk).

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

Preferred amylase enzymes include those described in WO95/26397 and in co-pending application by Novo Nordisk PCT/DK96/00056 now WO 96/23873.

The amylolytic enzymes are incorporated in the detergent compositions of the present invention a level of from 0.0001% to 2%, preferably from 0.00018% to 0.06%, more preferably from 0.00024% to 0.048% pure enzyme by weight of the composition In a particularly preferred embodiment, detergent tablets of the present invention comprise amylase enzymes, particularly those described in WO95/26397 and co-pending application by Novo Nordisk PCT/DK96/00056 now WO 96/23873 in combination with a complementary amylase.

By "complementary" it is meant the addition of one or more amylase suitable for detergency purposes. Examples of complementary amylases (α and/or β) are described below. WO94/02597 and WO95/10603, Novo Nordisk-A/S describe cleaning compositions which incorporate mutant amylases. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314, and WO96/05295, Genencor and amylase variants having additional modification in the immediate parent available from Novo Nordisk A/S, disclosed in WO 95/10603. Also suitable are amylases described in EP 277 216 (Novo Nordisk). Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382. Preferred complementary amylases for the present invention are the amylases sold under the tradename Purafect Ox Am® described in WO 94/18314, WO96/05295 sold by Genencor; Termamyl®, Fungamyl®, Ban® and Duramyl®, all available from Novo Nordisk A/S and Maxamyl® by Gist-Brocades.

Said complementary amylase is generally incorporated in the detergent compositions of the present invention a level of from 0.0001% to 2%, preferably from 0.00018% to 0.06%, more preferably from 0.00024% to 0.048% pure enzyme by weight of the composition. Preferably a weight of pure enzyme ratio of specific amylase to the complementary amylase is comprised between 9:1 to 1:9, more preferably between 4:1 to 1:4, and most preferably between 2:1 and 1:2.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

Said enzymes are normally incorporated in the detergent composition at levels from 0.0001% to 2% of active enzyme by weight of the detergent composition. The enzymes can be added as separate single ingredients (prills, granulates, stabilized liquids, etc. containing one enzyme) or as mixtures of two or more enzymes (e.g. cogranulates).

Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Bleach Destroying Agent

A bleach destroying agent is a preferred finishing additive of the non-compressed portion of detergent tablets suitable for use in automatic dishwashing. Bleach destroying agents are delivered to the later stages of the washing cycle of a dishwashing machine and serve to destroy any remaining bleach present at the end of the washing cycle. It is believed that bleaching agent carried over from the washing cycle to the rinsing cycle causes corrosion of silverware as described in EP-A-636 888.

The bleach destroying agent consists of one or more encapsulated additives. Suitable encapsulated additives include encapsulated enzymes suitable for oxygen destruction for example peroxidases, e.g. catalase, encapsulated reducing agents, e.g. thiosulphate, encapsulated heavy metals or compounds thereof e.g. copper, iron, manganese, zinc or titanium.

Suitable methods of encapsulation are those already known in the art. The preferred encapsulation dissolve gradually e.g. paraffin.

Perfume Component

Perfume components can be incorporated into the compressed portion, but are preferably incorporated as finishing additives of the non-compressed portion. By perfume component it is meant perfume oil, encapsulated perfumes, perfumes wich have been applied to a porous carrier and then optionally encapsulated, pro-perfumes and mixtures thereof. Suitable perfumes include those commonly available in the art.

Organic Polymeric Compound

Organic polymeric compounds may be incorporated into the compressed portion, but are preferably finishing additives of the non-compressed portion in accord with the invention. By organic polymeric compound it is meant essentially any polymeric organic compound commonly found in detergent compositions having dispersant, anti-redeposition, soil release agents or other detergency properties.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids, modified polycarboxylates or their salts in which the polycarboxylic acid comprises at least two carboxyl radicals separated from each other by not more than two carbon atoms. Polymers of the latter type are disclosed in GB-A-1,596,756. Examples of such salts are polyacrylates of molecular weight from 500 to 200,000, more preferably from 1,000 to 100,000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a molecular weight of from 20,000 to 100,000.

Preferred commercially available acrylic acid containing polymers having a molecular weight below 15,000 include those sold under the tradename Sokalan PA30, PA20, PA15, PA10 and Sokalan CP10 by BASF GmbH, and those sold under the tradename Acusol 45N, 480N, 460N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a molecular weight of 3500 and contains 60% to 80% by weight of acrylic acid and 40% to 20% by weight of methacrylic acid.

The polyamine and modified polyamine compounds are useful herein including those derived from aspartic acid such as those disclosed in EP-A-305282, EP-A-305283 and EP-A-351629.

Other optional polymers may include polyethylene immines (described in U.S. patent application Ser. No. 08/841447 now U.S. Pat. No. 5,968,893, polyethylene or polypropylene glycol, polyvinyl alcohols and acetates both modified and non-modified, cellulosics and modified cellulosics, polyoxyethylenes, polyoxypropylenes, and copolymers thereof, both modified and non-modified, terephthalate esters of ethylene or propylene glycol or mixtures thereof with polyoxyalkylene units.

Suitable examples are disclosed in U.S. Pat. Nos. 5,591,703, 5,597,789 and 4,490,271.

Examples of polymeric soil release agents include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly(vinyl ester) segments, preferably polyvinyl acetate, having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, or a combination of (a) and (b).

Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful herein also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al.

Another suitable soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 to Hays, issued May 25, 1976 and U.S. Pat. No. 3,893,929 to Basadur issued Jul. 8, 1975.

Another suitable polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Other polymeric soil release agents also include the soil release agents of U.S. Pat. No. 4,877,896, issued Oct. 31, 1989 to Maldonado et al, which discloses anionic, especially sulfoarolyl, end-capped terephthalate esters.

Another soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1, 2-propyleneoxy units in a ratio of from 1.7 to 1.8, and two end-cap units of sodium 2-(2-hydroxyethoxy)-ethanesulfonate.

Other suitable soil release agents include water-soluble cationic ethoxylated amine compounds with particulate soil/clay-soil removal and/or anti-redeposition properties. These cationic compounds are described in more detail in EP-B-111965, U.S. Pat. No. 4,659,802 and U.S. Pat. No. 4,664,848. Particularly preferred of these cationic compounds are ethoxylated cationic monoamines, diamines or triamines. Especially preferred are the ethoxylated cationic monoamines, diamines and triamines of the formula:

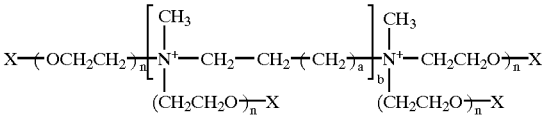

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 2, 1 or 0; for cationic monoamines (b=0), n is preferably at least 16, with a typical range of from 20 to 35; for cationic diamines or triamines, n is preferably at least about 12 with a typical range of from about 12 to about 42. These compounds where present in the composition, are generally present in an amount of from 0.01 to 30% by weight, preferably 0.05 to 10% by weight.

Co-builder

Co-builders can be incorporated into the compressed portion, but are preferably incorporated as finishing additive of the non-compressed portion. By co-builder it is meant a compound which acts in addition to a builder compound (as described below) to sequester (chelate) heavy metal ions. These components may also have calcium and magnesium chelation capacity, but preferentially they show selectivity to binding heavy metal ions such as iron, manganese and copper.

Co-builders are generally present at a level of from 0.005% to 20%, preferably from 0.1% to 10%, more preferably from 0.25% to 7.5% and most preferably from 0.5% to 5% by weight of the compositions.

Co-builders, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the co-builder is preferably at least 1:1.

Suitable co-builders for use herein include organic phosphonates, such as the amino alkylene poly(alkylene phosphonates), alkali metal ethane 1-hydroxy disphosphonates and nitrilo trimethylene phosphonates. Preferred among the above species are diethylene triamine penta (methylene phosphonate), ethylene diamine tri(methylene phosphonate)hexamethylene diamine tetra(methylene phosphonate) and hydroxy-ethylene 1,1 diphosphonate.

Other suitable co-builders for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Cationic Fabric Softening Agents

Cationic fabric softening agents are suitable finishing additives in detergent tablets which are suitable for use in methods of laundry washing. The cationic softening agents can be delivered to the wash in the later stages of the wash cycle but are preferably delivered in the rinse cycle of the washing. Suitable cationic fabric softening agents include the water insoluble tertiary amines or dilong chain amide materials as disclosed in GB-A-1 514 276 and EP-B-0 011 340.

Cationic fabric softening agents are typically incorporated at total levels of from 0.5% to 15% by weight, normally from 1% to 5% by weight.

Crystal Growth Inhibitor

The non-compressed portion preferably contains a crystal growth inhibitor, preferably an organodiphosphonic acid component, incorporated preferably at a level of from 0.01% to 5%, more preferably from 0.1% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Nonionic Surfactant

Essentially any nonionic surfactants can be included in either the compresed or non-compressed portions of the detergent tablet. Preferred, non-limiting classes of useful nonionic surfactants are listed below. Preferred nonionic surfacatnt incorpoarated into the compressed portion provide a suds suppression benefit. In a preferred aspect of the present invention, the finishing additive is a rinse aid composition (described later) comprising nonionic surfactant and a source of acidity.

Nonionic Ethoxylated Alcohol Surfactant

The alkyl ethoxylate condensation products of aliphatic alcohols with from 1 to 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

End-capped Alkyl Alkoxylate Surfactant

A suitable endcapped alkyl alkoxylate surfactant is the epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5, more preferably 1; and y is an integer having a value of at least 15, more preferably at least 20.

Preferably, the surfactant of formula I, at least 10 carbon atoms in the terminal epoxide unit $[CH_2CH(OH)R_2]$. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Ether-capped Poly(oxyalkylated) Alcohols

Preferred surfactants for use herein include ether-capped poly(oxyalkylated) alcohols having the formula:

$$R^1O[CH_2CH(R^3)O]_x[CH_2]_kCH(OH)[CH_2]_jOR^2$$

wherein $R^1$ and $R^2$ are linear or branched, saturated or unsaturated, aliphatic or aromatic hydrocarbon radicals having from 1 to 30 carbon atoms; $R^3$ is H, or a linear aliphatic hydrocarbon radical having from 1 to 4 carbon atoms; x is an integer having an average value from 1 to 30, wherein when x is 2 or greater $R^3$ may be the same or different and k and j are integers having an average value of from 1 to 12, and more preferably 1 to 5. $R^1$ and $R^2$ are preferably linear or branched, saturated or unsaturated, aliphatic or aromatic hydrocarbon radicals having from 6 to 22 carbon atoms with 8 to 18 carbon atoms being most preferred. H or a linear aliphatic hydrocarbon radical having from 1 to 2 carbon atoms is most preferred for $R^3$. Preferably, x is an integer having an average value of from 1 to 20, more preferably from 6 to 15.

As described above, when, in the preferred embodiments, and x is greater than 2, $R^3$ may be the same or different. That is, $R^3$ may vary between any of the alklyeneoxy units as described above. For instance, if x is 3, $R^3$ may be selected to form ethlyeneoxy(EO) or propyleneoxy(PO) and may vary in order of (EO)(PO)(EO), (EO)(EO)(PO); (EO)(EO)(EO); (PO)(EO)(PO); (PO)(PO)(EO) and (PO)(PO)(PO). Of course, the integer three is chosen for example only and the variation may be much larger with a higher integer value for x and include, for example, mulitple (EO) units and a much small number of (PO) units.

Particularly preferred surfactants as described above include those that have a low cloud point of less than 20° C. These low cloud point surfactants may then be employed in conjunction with a high cloud point surfactant as described in detail below for superior grease cleaning benefits.

Most preferred ether-capped poly(oxyalkylated) alcohol surfactants are those wherein k is 1 and j is I so that the surfactants have the formula:

$$R_1O[CH_2CH(R^3)O]_xCH_2CH(OH)CH_2OR^2$$

where $R^1$, $R^2$ and $R^3$ are defined as above and x is an integer with an average value of from 1 to 30, preferably from 1 to 20, and even more preferably from 6 to 18. Most preferred are surfactants wherein $R^1$ and $R^2$ range from 9 to 14, $R^3$ is H forming ethyleneoxy and x ranges from 6 to 15.

The ether-capped poly(oxyalkylated) alcohol surfactants comprise three general components, namely a linear or branched alcohol, an alkylene oxide and an alkyl ether end cap. The alkyl ether end cap and the alcohol serve as a hydrophobic, oil-soluble portion of the molecule while the alkylene oxide group forms the hydrophilic, water-soluble portion of the molecule.

These surfactants exhibit significant improvements in spotting and filming characteristics and removal of greasy soils, when used in conjunction with high cloud point surfactants, relative to conventional surfactants.

Generally speaking, the ether-capped poly(oxyalkylene) alcohol surfactants of the present invention may be produced by reacting an aliphatic alcohol with an epoxide to form an ether which is then reacted with a base to form a second epoxide. The second epoxide is then reacted with an alkoxylated alcohol to form the novel compounds of the present invention. Examples of methods of preparing the ether-capped poly(oxyalkylated) alcohol surfactants are described below:

Preparation of $C_{12/14}$ Alkyl Glycidyl Ether

A $C_{12/14}$ fatty alcohol (100.00 g, 0.515 mol.) and tin (IV) chloride (0.58 g, 2.23 mmol, available from Aldrich) are combined in a 500 mL three-necked round-bottomed flask fitted with a condenser, argon inlet, addition funnel, magnetic stirrer and internal temperature probe. The mixture is heated to 60° C. Epichlorhydrin (47.70 g, 0.515 mol, available from Aldrich) is added dropwise so as to keep the temperature between 60–65° C. After stirring an additional hour at 60° C., the mixture is cooled to room temperature. The mixture is treated with a 50% solution of sodium hydroxide (61.80 g, 0.773 mol, 50%) while being stirred mechanically. After addition is completed, the mixture is heated to 90° C. for 1.5 h, cooled, and filtered with the aid of ethanol. The filtrate is separated and the organic phase is washed with water (100 mL), dried over $MgSO_4$, filtered, and concentrated. Distillation of the oil at 100–120° C. (0.1 mm Hg) providing the glycidyl ether as an oil.

Preparation of $C_{12/14}$ Alkyl-$C_{9/11}$ Ether Capped Alcohol Surfactant

Neodol® 91-8 (20.60 g, 0.0393 mol ethoxylated alcohol available from the Shell chemical Co.) and tin (IV) chloride (0.58 g, 2.23 mmol) are combined in a 250 mL three-necked round-bottomed flask fitted with a condenser, argon inlet, addition funnel, magnetic stirrer and internal temperature probe. The mixture is heated to 60° C. at which point $C_{12/14}$ alkyl glycidyl ether (11.00 g, 0.0393 mol) is added dropwise over 15 min. After stirring for 18 h at 60° C., the mixture is cooled to room temperature and dissolved in an equal portion of dichloromethane. The solution is passed through a 1 inch pad of silica gel while eluting with dichloromethane. The filtrate is concentrated by rotary evaporation and then stripped in a kugelrohr oven (100° C., 0.5 mm Hg) to yield the surfactant as an oil.

Nonionic Ethoxylated/propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10-C18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from 1500 to 1800 and exhibits water insolubility. Examples of compounds of this type include certain of the commercially-available Pluronic™ surfactants, marketed by BASF.

Nonionic EO Condensation Products with Propylene Oxide/ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from 2500 to 3000. Examples of this type of nonionic surfactant include certain of the commercially available Tetronic™ compounds, marketed by BASF.

Mixed Nonionic Surfactant System

In a preferred embodiment of the present invention the detergent tablet comprises a mixed nonionic surfactant system comprising at least one low cloud point nonionic surfactant and at least one high cloud point nonionic surfactant as described in U.S. patent application Ser. No. 08/764 826 now U.S. Pat. No. 5,877,134.

In a preferred embodiment the detergent tablet comprising such a mixed surfactant system also comprises an amount of water-soluble salt to provide conductivity in deionised water measured at 25° C. greater than 3 milli Siemens/cm, preferably greater than 4 milli Siemens/cm, most preferably greater than 4.5 milli Siemens/cm.

In another preferred embodiment the mixed surfactant system dissolves in water having a hardness of 1 .246 mmol/L in any suitable cold-fill automatic dishwasher to provide a solution with a surface tension of less than 4 Dynes/$cm^2$ at less than 45° C., preferably less than 40° C., most preferably less than 35° C. as described in U.S. patent application Ser. No. 08/764 826 now U.S. Pat. No. 5,877,134.

In another preferred embodiment the high cloud point and low cloud point surfactants of the mixed surfactant system are separated such that one of either the high cloud point or low cloud point surfactants is present in a first matrix and the other is present in a second matrix as described in U.S. patent application Ser. No. 08/764 826 now U.S. Pat. No. 5,877,134. For the purposes of the present invention, the first matrix may be a first particulate and the second matrix may be a second particulate. A surfactant may be applied to a particulate by any suitable known method, preferably the surfactant is sprayed onto the particulate. In a preferred aspect the first matrix is the compressed portion and the second matrix is the non-compressed portion of the detergent tablet of the present invention. Preferably the low cloud point surfactant is present in the compressed portion and the high cloud point surfactant is present in the non-compressed portion of the detergent tablet of the present invention.

Rinse Aid

In a preferred aspect of the present invention, the non-compressed portion comprises a rinse aid. By rinse aid it is meant a composition that is delivered in the rinse cycle of the automatic dishwasher and provide improved drainage of water and reduced spot and film formation on dishware.

The rinse aid composition for use herein may comprise any of the components commonly found as components of rinse aid compositions, for example nonionic surfactants (described above), hydrotropes, solvent and a source of acidity.

Suitable hydrotropes include sodium, potassium and ammonium xylene sulfonates, toluene sulfonate, cumene sulfonates and mixtures thereof. Hydrotrope is typically present at a level of from 0.5% to 20% by weight, preferably 1% to 10% by weight of the rinse aid composition.

The rinse aid composition may contain one or more solvent at levels of from 1% to 30% by weight, preferably from 3% to 25% by weight, more preferably from 5% to 20% by weight of the rinse aid composition, particularly when in liquid or gel form. Suitable solvents for use herein include the organic solvent having the general formula $RO(CH_2C(Me)HO)_nH$, wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=1); and 1(2-n-butoxy-1-methylethoxy)propane-2-ol (n=2), and mixtures thereof.

Other solvents useful herein include the water soluble CARBITOL solvents or water-soluble CELLOSOLVE solvents. Water-soluble CARBITOL solvents are compounds of the 2-(2 alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE solvents are compounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (eg: ethanol, propanol, isopropanol, butanol and mixtures thereof) are preferred, with ethanol particularly preferred. The C1–C4 dihydric alcohols, including propylene glycol, are also preferred.

The pH of the rinse aid composition is preferably less than 7. The pH is adjusted by incorporating a source of acidity for example inorganic or organic acids including for example carboxylate acids (e.g. citric acid or succinic acid), polycarboxylate acids (e.g. polyacrylic acid), acetic acid, boric acid, malonic acid, adipic acid, fumaric acid, lactic acid, glycolic aicd, tartaric acid, tartronic acid, maleic acid, derivatives and mixtures thereof. A preferred acidity source is citric acid.

The rinse aid composition may also comprise other components such as builders, co-builders and other polymeric compounds (described above), especially polyethylene glycol (PEG), polyvinyl pyrrolidone, polyacrylate (especially those described in U.S. Pat. No. 5,240,632), polymethacrylate and copolymers thereof, acrylonitrile.

Process

As described above, the detergent tablets described herein are prepared by separately preparing the composition of finishing additives and/or detergent components forming the respective compressed portion and the non-compressed portion, then delivering or adhering the composition of the non-compressed portion to the compressed portion.

The compressed portion comprises at least one, but preferably more than one detergent component. The compressed portion is prepared by pre-mixing at least one, but preferably a mixture of detergent components and/or optional carrier components to form a composition. Any pre-mixing will be carried out in a suitable mixer; for example a pan mixer, rotary drum, vertical blender or high shear mixer. Preferably dry particulate components are admixed in a mixer, as described above, and liquid components are applied to the dry particulate components, for example by spraying the liquid components directly onto the dry particulate components. The resulting composition is then formed into a compressed portion in a compression step using any known suitable equipment. Preferably the composition is formed into a compressed portion using a tablet press, wherein the tablet is prepared by compression of the composition between an upper and a lower punch. In a preferred embodiment of the present invention the composition is delivered into a punch cavity of a tablet press and compressed to form a compressed portion using a pressure of preferably greater than 6.3 $KN/cm^2$, more preferably greater than 9 $KN/cm^2$, most preferably greater than 14.4 $KN/cm^2$.

In order to form a preferred tablet of the invention, wherein the compressed portion provides a mould to receive the non-compressed portion, the compressed portion is prepared using a modified tablet press comprising modified upper and/or lower punches. The upper and lower punches of the modified tablet press are modified such that the compressed portion provides one or more indentations which form a mould(s) to which the non-compressed portion is delivered.

The non-compressed portion comprises a finishing additive, but may also optionally comprise one or more detergent components. The components of the non-compressed portion are pre-mixed using any known suitable mixing equipment. In addition the non-compressed portion may optionally comprise a carrier with which the finishing additive and optional detergent components are combined. The non-compressed portion may be prepared in solid or flowable form. Once prepared the composition is delivered to the compressed portion. The non-compressed portion may be delivered to the compressed portion by manual delivery or using a nozzle feeder or extruder. Where the compressed portion comprises a mould, the non-compressed portion is preferably delivered to the mould using accurate delivery equipment, for example a nozzle feeder, such as a loss in weight screw feeder available from Optima, Germany or an extruder.

Where the flowable non-compressed portion is in particulate form the process comprises delivering a flowable non-compressed portion to the compressed portion in a delivery step and then coating at least a portion of the non-compressed portion with a coating layer such that the coating layer has the effect of substantially adhering the non-compressed portion to the compressed portion.

Where the flowable non-compressed portion is affixed to the compressed portion by hardening, the process comprises a delivery step in which the flowable non-compressed portion is delivered to the compressed portion and a subsequent conditioning step, wherein the non-compressed portion hardens. Such a conditioning step may comprise drying, cooling, binding, polymerisation etc. of the non-compressed portion, during which the non-compressed portion becomes solid, semi-solid or highly viscous. Heat may be used in a drying step. Heat, or exposure to radiation may be used to effect polymerisation in a polymerisation step.

It is also envisaged that the compressed portion may be prepared having a plurality of moulds. The plurality of moulds are then filled with a non-compressed portion. It is also envisaged that each mould can be filled with a different non-compressed portion or alternatively, each mould can be filled with a plurality of different non-compressed portions.

Detergent Components

The compressed portion of the detergent tablets described herein are prepared by compression composition of at least one, but preferably a mixture of detergent components. A suitable pre-mixed composition may include a variety of different detergent active components including builder compounds, surfactants, enzymes, bleaching agents (both oxygen releasing and chlorine), alkalinity sources, colourants, perfume, lime soap dispersants, organic polymeric compounds including polymeric dye transfer inhibiting agents, crystal growth inhibitors, co-builders, metal ion salts, enzyme stabilisers, corrosion inhibitors, suds suppressers, solvents, fabric softening agents, optical brighteners and hydrotropes.

Highly preferred detergent components of the compressed portion include a builder compound, a surfactant, enzyme and bleaching agent.

Builder Compound

The detergent tablets of the present invention preferably contain a builder compound, typically present at a level of from 1% to 80% by weight, preferably from 10% to 70% by weight, most preferably from 20% to 60% by weight of the composition of active detergent components.

Water-soluble Builder Compound

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that 50° C., especially less than 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Partially Soluble or Insoluble Builder Compound

The detergent tablets of the present invention may contain a partially soluble or insoluble builder compound. Partially soluble and insoluble builder compounds are particularly suitable for use in tablets prepared for use in laundry cleaning methods. Examples of partially water soluble builders include the crystalline layered silicates as disclosed for example, in EP-A-0164514, DE-A-3417649 and DE-A-3742043. Preferred are the crystalline layered sodium silicates of general formula $$NaMSi_xO_{2+1}.yH_2O$$

wherein M is sodium or hydrogen, x is a number from 1.9 to 4 and y is a number from 0 to 20. Crystalline layered sodium silicates of this type preferably have a two dimensional 'sheet' structure, such as the so called 8-layered structure, as described in EP 0 164514 and EP 0 293640.

Methods for preparation of crystalline layered silicates of this type are disclosed in DE-A-3417649 and DE-A-3742043. For the purpose of the present invention, x in the general formula above has a value of 2,3 or 4 and is preferably 2.

The most preferred crystalline layered sodium silicate compound has the formula δ-$Na_2Si_2O_5$, known as NaSKS-6 (trade name), available from Hoechst AG.

The crystalline layered sodium silicate material is preferably present in granular detergent compositions as a particulate in intimate admixture with a solid, water-soluble ionisable material as described in PCT Patent Application No. WO92/18594. The solid, water-soluble ionisable material is selected from organic acids, organic and inorganic acid salts and mixtures thereof, with citric acid being preferred.

Examples of largely water insoluble builders include the sodium aluminosilicates. Suitable aluminosilicates include the aluminosilicate zeolites having the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof.

A preferred method of synthesizing aluminosilicate zeolites is that described by Schoeman et al (published in Zeolite (1994) 14(2), 110–116), in which the author describes a method of preparing colloidal aluminosilicate zeolites. The colloidal aluminosilicate zeolite particles should preferably be such that no more than 5% of the particles are of size greater than 1 μm in diameter and not more than 5% of particles are of size less then 0.05 μm in diameter. Preferably the aluminosilicate zeolite particles have an average particle size diameter of between 0.01 μm and 1 μm, more preferably between 0.05 μm and 0.9 μm, most preferably between 0.1 μm and 0.6 μm.

Zeolite A has the formula $$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276H_2O$. Zeolite MAP, as disclosed in EP-B-384,070 is a preferred zeolite builder herein.

Preferred aluminosilicate zeolites are the colloidal aluminosilicate zeolites. When employed as a component of a detergent composition colloidal aluminosilicate zeolites, especially colloidal zeolite A, provide enhanced builder performance in terms of providing improved stain removal. Enhanced builder performance is also seen in terms of reduced fabric encrustation and improved fabric whiteness maintenance; problems believed to be associated with poorly built detergent compositions.

A surprising finding is that mixed aluminosilicate zeolite detergent compositions comprising colloidal zeolite A and colloidal zeolite Y provide equal calcium ion sequestration performance versus an equal weight of commercially available zeolite A. Another surprising finding is that mixed aluminosilicate zeolite detergent compositions, described above, provide improved magnesium ion sequestration performance versus an equal weight of commercially available zeolite A.

Surfactant

Surfactants are preferred detergent active components of the compositions described herein. Suitable surfactants are selected from anionic, cationic, nonionic, ampholytic and zwitterionic surfactants and mixtures thereof. Automatic dishwashing machine products should be low foaming in character and thus the foaming of the surfactant system for use in dishwashing methods must be suppressed or more preferably be low foaming, typically nonionic in character. Sudsing caused by surfactant systems used in laundry cleaning methods need not be suppressed to the same extent as is necessary for dishwashing. The surfactant is typically present at a level of from 0.2% to 30% by weight, more preferably from 0.5% to 10% by weight, most preferably from 1% to 5% by weight of the composition of active detergent components.

A typical listing of anionic, nonionic, ampholytic and zwitterionic classes, and species of these surfactants, is given in U.S. Pat. No. 3,929,678 issued to Laughlin and Heuring on Dec., 30, 1975. A list of suitable cationic surfactants is given in U.S. Pat. No. 4,259,217 issued to Murphy on Mar. 31, 1981. A listing of surfactants typically included in automatic dishwashing detergent compositions is given for example, in EP-A-0414 549 and PCT Applications Nos. WO 93/08876 and WO 93/08874.

Nonionic Surfactant

Suitable nonionic surfactants are described above.

Anionic Surfactant

Essentially any anionic surfactants useful for detersive purposes are suitable. These can include salts (including, for example, sodium, potassium, ammonium, and substituted ammonium salts such as mono-, di- and triethanolamine salts) of the anionic sulfate, sulfonate, carboxylate and sarcosinate surfactants, Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{1\ 2}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10-C18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10-C1\ 8}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula $R—CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(™) C2M Conc. manufactured by Miranol, Inc., Dayton, N.J.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Cationic ester surfactants used in this invention are preferably water dispersible compound having surfactant properties comprising at least one ester (i.e. —COO—) linkage and at least one cationically charged group. Other suitable cationic ester surfactants, including choline ester surfactants, have for example been disclosed in U.S. Pat. Nos. 4,228,042, 4,239,660 and 4,260,529.

Suitable cationic surfactants include the quatemary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Water-soluble Sulfate Salt

The detergent tablet optionally contains a water-soluble sulfate salt. Where present the water-soluble sulfate salt is at the level of from 0.1% to 40%, more preferably from 1% to 30%, most preferably from 5% to 25% by weight of the compositions.

The water-soluble sulfate salt may be essentially any salt of sulfate with any counter cation. Preferred salts are selected from the sulfates of the alkali and alkaline earth metals, particularly sodium sulfate.

Alkali Metal Silicate

According to an embodiment of the present invention an alkali metal silicate is an essential component of the detergent tablet. In other embodiments of the present invention the presence of an alkali metal silicate is optional. A preferred alkali metal silicate is sodium silicate having an $SiO_2$:$Na_2O$ ratio of from 1.8 to 3.0, preferably from 1.8 to 2.4, most preferably 2.0. Sodium silicate is preferably present at a level of less than 20%, preferably from 1% to 15%, most preferably from 3% to 12% by weight of $SiO_2$. The alkali metal silicate may be in the form of either the anhydrous salt or a hydrated salt.

Alkali metal silicate may also be present as a component of an alkalinity system.

The alkalinity system also preferably contains sodium metasilicate, present at a level of at least 0.4% $SiO_2$ by weight. Sodium metasilicate has a nominal $SiO_2$:$Na_2O$ ratio of 1.0. The weight ratio of said sodium silicate to said sodium metasilicate, measured as $SiO_2$, is preferably from 50:1 to 5:4, more preferably from 15:1 to 2:1, most preferably from 10:1 to 5:2.

Colourant

The term 'colourant', as used herein, means any substance that absorbs specific wavelengths of light from the visible light spectrum. Such colourants when added to a detergent composition have the effect of changing the visible colour and thus the appearance of the detergent composition. Colourants may be for example either dyes or pigments. Preferably the colourants are stable in composition in which they are to be incorported. Thus in a composition of high pH the colourant is preferably alkali stable and in a composition of low pH the colourant is preferably acid stable.

The compressed portion and/or non compressed may contain a colourant, a mixture of colourants, coloured particles or mixture of coloured particles such that the compressed portion and the non-compressed portion have different visual appearances. Preferably one of either the compressed portion or the non-compressed comprises a colourant.

Where the non-compressed portion comprises two or more compositions of active detergent components, preferably at least one of either the first and second and/or subsequent compositions comprises a colourant. Where both the first and second and/or subsequent compositions comprise a colourant it is preferred that the colourants have a different visual appearance.

Where present the coating layer preferably comprises a colourant. Where the compressed portion and the coating layer comprise a colourant, it is preferred that the colourants provide a different visual effect.

Examples of suitable dyes include reactive dyes, direct dyes, azo dyes. Preferred dyes include phthalocyanine dyes, anthraquinone dye, quinoline dyes, monoazo, disazo and polyazo. More preferred dyes include anthraquinone, quinoline and monoazo dyes. Preferred dyes include SANDOLAN E-HRL 180% (tradename), SANDOLAN MILLING BLUE (tradename), TURQUOISE ACID BLUE (tradename) and SANDOLAN BRILLIANT GREEN (tradename) all available from Clariant UK, HEXACOL QUINOLINE YELLOW (tradename) and HEXACOL BRILLIANT BLUE (tradename) both available from Pointings, UK, ULTRA MARINE BLUE (tradename) available from Holliday or LEVAFIX TURQUISE BLUE EBA (tradename) available from Bayer, USA.

The colourant may be incorporated into the compressed and/or non-compressed portion by any suitable method. Suitable methods include mixing all or selected active detergent components with a colourant in a drum or spraying all or selected active detergent components with the colourant in a rotating drum.

Colourant when present as a component of the compressed portion is present at a level of from 0.001% to 1.5%, preferably from 0.01% to 1.0%, most preferably from 0.1% to 0.3%. When present as a component of the non-compressed portion, colourant is generally present at a level of from 0.001% to 0.1%, more preferably from 0.005% to 0.05%, most preferably from 0.007% to 0.02%. When present as a component of the coating layer, colourant is present at a level of from 0.01% to 0.5%, more preferably from 0.02% to 0.1%, most preferably from 0.03% to 0.06%.

Corrosion Inhibitor Compound

The detergent tablets of the present invention suitable for use in dishwashing methods may contain corrosion inhibitors preferably selected from organic silver coating agents, particularly paraffin, nitrogen-containing corrosion inhibitor compounds and Mn(II) compounds, particularly Mn(II) salts of organic ligands.

Organic silver coating agents are described in PCT Publication No. WO94/16047 and copending European application No. EP-A-690122. Nitrogen-containing corrosion inhibitor compounds are disclosed in copending European Application no. EP-A-634,478. Mn(II) compounds for use in corrosion inhibition are described in copending European Application No. EP-A-672 749.

Organic silver coating agent may be incorporated at a level of from 0.05% to 10%, preferably from 0.1% to 5% by weight of the total composition.

The functional role of the silver coating agent is to form 'in use' a protective coating layer on any silverware components of the washload to which the compositions of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to 40 carbon atoms in the hydrocarbon chain.

The fatty acid portion of the fatty ester can be obtained from mono- or poly-carboxylic acids having from 1 to 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, Valerie acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl proprionate. Fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from 35° C. to 110° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Polymeric soil release agents can also be used as an organic silver coating agent.

A preferred organic silver coating agent is a paraffin oil, typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of from 1:10 to 2:1, preferably from 1:5 to 1:1. A paraffin oil meeting these characteristics, having a ratio of cyclic to noncyclic hydrocarbons of 32:68, is sold by Wintershall, Salzbergen, Germany, under the trade name WINOG 70.

Nitrogen-containing Corrosion Inhibitor Compounds

Suitable nitrogen-containing corrosion inhibitor compounds include imidazole and derivatives thereof such as benzimidazole, 2-heptadecyl imidazole and those imidazole derivatives described in Czech Patent No. 139, 279 and British Patent GB-A-1,137,741, which also discloses a method for making imidazole compounds.

Also suitable as nitrogen-containing corrosion inhibitor compounds are pyrazole compounds and their derivatives, particularly those where the pyrazole is substituted in any of the 1, 3, 4 or 5 positions by substituents $R_1$, $R_3$, $R_4$ and $R_5$ where $R_1$ is any of H, $CH_2OH$, $CONH_3$, or $COCH_3$, $R_3$ and $R_5$ are any of $C_1$–$C_{20}$ alkyl or hydroxyl, and $R_4$ is any of H, $NH_2$ or $NO_2$.

Other suitable nitrogen-containing corrosion inhibitor compounds include benzotriazole, 2-mercaptobenzothiazole, 1-phenyl-5-mercapto-1,2,3,4-tetrazole, thionalide, morpholine, melamine, distearylamine, stearoyl stearamide, cyanuric acid, aminotriazole, aminotetrazole and indazole.

Nitrogen-containing compounds such as amines, especially distearylamine and ammonium compounds such as ammonium chloride, ammonium bromide, ammonium sulphate or diammonium hydrogen citrate are also suitable.

Mn(II) Corrosion Inhibitor Compounds

The detergent tablets may contain an Mn(II) corrosion inhibitor compound. The Mn(II) compound is preferably incorporated at a level of from 0.005% to 5% by weight, more preferably from 0.01% to 1%, most preferably from 0.02% to 0.4% by weight of the compositions. Preferably, the Mn(II) compound is incorporated at a level to provide from 0.1 ppm to 250 ppm, more preferably from 0.5 ppm to 50 ppm, most preferably from 1 ppm to 20 ppm by weight of Mn(II) ions in any bleaching solution.

The Mn(II) compound may be an inorganic salt in anhydrous, or any hydrated forms. Suitable salts include manganese sulphate, manganese carbonate, manganese phosphate, manganese nitrate, manganese acetate and manganese chloride. The Mn(II) compound may be a salt or complex of an organic fatty acid such as manganese acetate or manganese stearate.

The Mn(II) compound may be a salt or complex of an organic ligand. In one preferred aspect the organic ligand is a heavy metal ion sequestrant. In another preferred aspect the organic ligand is a crystal growth inhibitor.

Other Corrosion Inhibitor Compounds

Other suitable additional corrosion inhibitor compounds include, mercaptans and diols, especially mercaptans with 4 to 20 carbon atoms including lauryl mercaptan, thiophenol, thionapthol, thionalide and thioanthranol. Also suitable are saturated or unsaturated $C_{10}$–$C_{20}$ fatty acids, or their salts, especially aluminium tristearate. The $C_{12}$–$C_{20}$ hydroxy fatty acids, or their salts, are also suitable. Phosphonated octadecane and other anti-oxidants such as betahydroxytoluene (BHT) are also suitable.

Copolymers of butadiene and maleic acid, particularly those supplied under the trade reference no. 07787 by Polysciences Inc have been found to be of particular utility as corrosion inhibitor compounds.

Hydrocarbon Oils

Another preferred active detergent component for use in the present invention is a hydrocarbon oil, typically a predominantly long chain, aliphatic hydrocarbons having a number of carbon atoms in the range of from 20 to 50; preferred hydrocarbons are saturated and/or branched; preferred hydrocarbon oil selected from predominantly branched $C_{25-45}$ species with a ratio of cyclic to noncyclic hydrocarbons of from 1:10 to 2:1, preferably from 1:5 to 1:1. A preferred hydrocarbon oil is paraffin. A paraffin oil meeting the characteristics as outlined above, having a ratio of cyclic to noncyclic hydrocarbons of 32:68, is sold by Wintershall, Salzbergen, Germany, under the trade name WINOG 70.

Water-soluble Bismuth Compound

The detergent tablets of the present invention suitable for use in dishwashing methods may contain a water-soluble bismuth compound, preferably present at a level of from 0.005% to 20%, more preferably from 0.01% to 5%, most preferably from 0.1% to 1% by weight of the compositions.

The water-soluble bismuth compound may be essentially any salt or complex of bismuth with essentially any inorganic or organic counter anion. Preferred inorganic bismuth salts are selected from the bismuth trihalides, bismuth nitrate and bismuth phosphate. Bismuth acetate and citrate are preferred salts with an organic counter anion.

Enzyme Stabilizing System

Preferred enzyme-containing compositions herein may comprise from 0.001% to 10%, preferably from 0.005% to 8%, most preferably from 0.01% to 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Lime Soap Dispersant Compound

The compositions of active detergent components may contain a lime soap dispersant compound, preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. Preferred lime soap disperant compounds are disclosed in PCT Application No. WO93/08877.

Suds Suppressing System

The detergent tblets of the present invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. WO93/08876 and EP-A-705 324.

Polymeric Dye Transfer Inhibiting Agents

The detergent tablets herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Optical Brightener

The detergent tablets suitable for use in laundry washing methods as described herein, also optionally contain from 0.005% to 5% by weight of certain types of hydrophilic optical brighteners.

Hydrophilic optical brighteners useful herein include those having the structural formula:

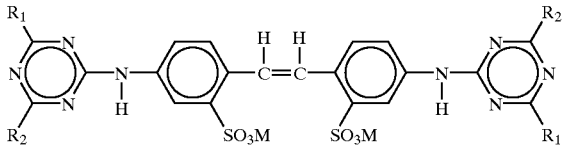

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Clay Softening System

The detergent tablets suitable for use in laundry cleaning methods may contain a clay softening system comprising a clay mineral compound and optionally a clay flocculating agent.

The clay mineral compound is preferably a smectite clay compound. Smectite clays are disclosed in the U.S. Pat. Nos. 3,862,058, 3,948,790, 3,954,632 and 4,062,647. European Patents Nos. EP-A-299,575 and EP-A-313,146 in the name of the Procter and Gamble Company describe suitable organic polymeric clay flocculating agents.

Other Optional Ingredients

Other optional ingredients suitable for inclusion in the compositions of the invention include perfumes and filler salts, with sodium sulfate being a preferred filler salt.

pH of the Compositions

The detergent tablets of the present invention are preferably not formulated to have an unduly high pH, in preference having a pH measured as a 1% solution in distilled water of from 8.0 to 12.5, more preferably from 9.0 to 11.8, most preferably from 9.5 to 11.5.

In another aspect of the present invention the compressed and non-compressed portions are formulated to deliver different pH. In the rinse aid application described abobe, the compressed portion is formulated to deliver an alkaline pH whereas the non-compressed portion is formulated to deliver an acidic pH of less than 7, preferably between 0.5 and 6.5, most preferably between 1.0 and 5.0.

Machine Dishwashing Method

Any suitable methods for machine washing or cleaning soiled tableware are envisaged. A preferred machine dishwashing method comprises treating soiled articles selected from crockery, glassware, silverware, metallic items, cutlery and mixtures thereof, with an aqueous liquid having dissolved or dispensed therein an effective amount of a detergent tablet in accord with the invention. By an effective amount of the detergent tablet it is meant from 8 g to 60 g of product dissolved or dispersed in a wash solution of volume from 3 to 10 liters, as are typical product dosages and wash solution volumes commonly employed in conventional machine dishwashing methods. Preferably the detergent tablets are from 15 g to 40 g in weight, more preferably from 20 g to 35 g in weight.

Laundry Washing Method

Machine laundry methods herein typically comprise treating soiled laundry with an aqueous wash solution in a washing machine having dissolved or dispensed therein an effective amount of a machine laundry detergent tablet composition in accord with the invention. By an effective amount of the detergent tablet composition it is meant from 40 g to 300 g of product dissolved or dispersed in a wash solution of volume from 5 to 65 liters, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

EXAMPLES

Abbreviations Used in Examples

In the detergent compositions, the abbreviated component identifications have the following meanings:

| | |
|---|---|
| STPP | Sodium tripolyphosphate |
| Citrate | Tri-sodium citrate dihydrate |
| Bicarbonate | Sodium hydrogen carbonate |
| Citric Acid | Anhydrous Citric acid |
| Carbonate | Anhydrous sodium carbonate |
| Silicate | Amorphous Sodium Silicate ($SiO_2$:$Na_2O$ ratio = 1.6–3.2) |
| PB1 | Anhydrous sodium perborate monohydrate |
| PB4 | Sodium perborate tetrahydrate of nominal formula $NaBO_2.3H_2O.H_2O_2$ |
| Nonionic | nonionic surfactant $C_{13}$—$C_{15}$ mixed ethoxylated/propoxylated fatty alcohol with an average degree of ethoxylation of 3.8 and an average degree of propoxylation of 4.5, sold under the tradename Plurafac by BASF |
| TAED | Tetraacetyl ethylene diamine |
| HEDP | Ethane 1-hydroxy- 1,1-diphosphonic acid |
| DETPMP | Diethyltriamine penta (methylene) phosphonate, marketed by monsanto under the tradename Dequest 2060 |
| PAAC | Pentaamine acetate cobalt (III) salt |
| Paraffin | Paraffin oil sold under the tradename Winog 70 by Wintershall. |
| Protease | Proteolytic enzyme |
| Amylase | Amylolytic enzyme. |
| BTA | Benzotriazole |
| PA30 | Polyacrylic acid of average molecular weight approximately 4,500 |
| Sulphate | Anhydrous sodium sulphate. |
| PEG 4000 | Polyethylene Glycol molecular weight approximately 4000 available from Hoechst |
| PEG 8000 | Polyethylene Glycol molecular weight approximately 8000 available from Hoechst |
| Sugar | Household sucrose |
| Gelatine | Gelatine Type A, 65 bloom strength available from Sigma |
| Starch | modified carboxy methyl cellulose sold under the tradename Nimcel available from metcaserle |
| Dodecandioic acid | C12 dicarboxylic acid |
| Triacetin | Glycerin triacetate sold under the tradename available from |
| Thixatrol | Castor oil derivative sold under the tradename Thixatrol sold by Rheox |
| PVP | Poly vinyl pyrrolidone having a molecular weight of 300,000 |
| PEO | Polyethylene oxide having a molecular weight of 45,000 |
| pH | Measured as a 1% solution in distilled water at 20° C. |

In the following examples all levels are quoted as % by weight of the compressed portion, the non-compressed portion or the coating layer:

Example 1

The compressed portion is prepared by delivering the composition of detergent components to a punch cavity of a modified 12 head rotary tablet press and compressing the composition at a pressure of 13 $KN/cm^2$. The modified tablet press provides a tablet wherein the compressed portion has a mould. The non-compressed portion is poured into the mould of the compressed portion. For the purposes of Examples A to H the non-compressed portion comprises a gelling agent. Once the non-compressed portion has been delivered to the cavity the detergent tablet is subjected to a conditioning step, during which time the non-compressed portion hardens.

| | A | B | C | D |
|---|---|---|---|---|
| Compressed portion | | | | |
| STPP | 52.8 | 55.1 | 51.00 | — |
| Citrate | — | — | — | 26.4 |
| Carbonate | 15.4 | 14.0 | 14.00 | — |
| Silicate | 12.6 | 14.8 | 15.00 | 26.4 |
| Protease | — | 1.00 | — | — |
| Amylase | 0.95 | 0.75 | 0.75 | 0.60 |
| PB1 | 12.6 | 12.50 | 12.5 | 1.56 |
| PB4 | — | — | — | 6.92 |
| Nonionic | 1.65 | 1.50 | 2.00 | 1.50 |
| PAAC | — | 0.016 | — | 0.012 |
| TAED | — | — | — | 4.33 |
| HEDP | — | — | — | 0.67 |
| DETPMP | — | — | — | 0.65 |
| Paraffin | — | 0.50 | 0.50 | 0.42 |
| BTA | — | 0.30 | 0.30 | 0.24 |
| PA30 | — | — | — | 3.20 |
| Perfume | 0.05 | — | — | — |
| Sulphate | — | — | — | 24.0 |
| Misc/water to balance | 20.0 | 20.0 | 20.5 | 20.0 |
| Weight (g) | | | | |
| Non-compressed portion | | | | |
| Protease | 12.8 | — | 10.0 | 4.5 |
| N76D/S103A/V104I[1] | — | 8.0 | — | 4.5 |
| Amylase[2] | — | 13.0 | — | 5.0 |
| Nonionic Surfactant | 30.0 | 22.0 | 5.0 | 8.5 |
| Cellulose Ether[3] | 12.0 | 7.5 | 6.0 | 15.0 |
| Dipropyleneglycol butylether | — | — | 50.0 | 40.0 |
| Glycerol Triacetate | 34.0 | 34.0 | — | — |
| Thixatrol ST ® | — | — | 5.0 | 7.0 |
| Polyethylene glycol[4] | 4.0 | 2.0 | — | — |
| Metasilicate | — | — | — | 7.0 |
| Silicate | — | 10.0 | — | — |
| Bleach[5] | — | — | — | — |
| Misc/water | | | | |
| Weight(g) | 3.5 | 3.0 | 3.5 | 3.0 |

| | E | F | G | H |
|---|---|---|---|---|
| Compressed portion | | | | |
| STPP | 50.0 | 38.2 | 54.1 | |
| Citrate | — | — | — | 26.4 |
| Carbonate | 18.4 | 15.0 | 14.0 | |
| Silicate | 10.0 | 10.1 | 14.8 | 26.4 |
| Protease | — | | 1.00 | — |
| Amylase | 2.0 | 0.85 | 0.75 | 0.60 |
| PB1 | 15.7 | 11.0 | 12.60 | 15.7 |
| PB4 | — | — | — | — |
| Nonionic | 0.80 | 0.5 | 1.50 | 0.80 |
| PAAC | — | 0.008 | 0.016 | — |
| TAED | 1.30 | | — | 1.30 |
| HEDP | — | 0.92 | — | — |
| DETPMP | — | — | — | — |
| Paraffin | — | — | 0.50 | — |
| BTA | — | — | 0.3 | — |
| PA30 | — | — | — | — |
| Perfume | 0.2 | 0.2 | — | 0.2 |
| Sulphate | 10.6 | 22.0 | — | 10.6 |
| Misc/water to balance | | | | |
| Weight (g) | 25.0 | 30.0 | 20.0 | 25.0 |
| Non-compressed portion | | | | |
| Protease | — | 4.0 | — | — |
| N76D/S103A/V104I[1] | 8.0 | 4.0 | — | — |
| Amylase[2] | — | 13.0 | — | — |
| Nonionic Surfactant | 15.0 | 0.5 | 10.0 | 2.0 |
| Cellulose Ether[3] | 3.0 | 0.5 | 9.0 | 1.5 |
| Dipropyleneglycol butylether | — | 35.0 | 50.0 | — |
| Glycerol Triacetate | 44.0 | — | — | 38.0 |
| Thixatrol ST ® | 4.0 | — | 5.00 | 4.0 |
| Polyethylene glycol[4] | — | 3.0 | — | — |
| Metasilicate | — | 40.0 | — | — |
| Silicate | 26.0 | — | — | 28.0 |
| Bleach[5] | — | — | 5.0 | 25.0 |
| Misc/water | | | | |
| Weight (g) | 5.0 | 5.0 | 2.5 | 4.0 |

[1]As disclosed in U.S. 5,677,272.
[2]Amylase enzyme as disclosed in Novo Nordisk application PCT/DK96/00056 now WD96/23873 and is obtained from an alkalophilic Bacillus species having a N-terminal sequence of: His-His-Asn-Gly-Thr-Asn-Gly-Thr-Met-Met-Gln-Tyr-Phe-Glu-Trp-Tyr-Leu-Pro-Asn-Asp.
[3]selected from sodium carboxy methyl cellulose, methyl cellulose, hydroxy ethyl cellulose and hydroxy propyl cellulose and mixed ethers e.g. hydroxypropylmethylcellulose..
[4]MW 4,000–8,000.
[5]NaDCC, Sodium perborate or sodium per carbonate.

Example 2

The compressed portion is prepared by delivering the composition of detergent components to a punch cavity of a modified 12 head rotary tablet press and compressing the composition at a pressure of 13 KN/cm$^2$. The modified tablet press provides tablet wherein the compressed portion has a mould. For the purposes of Examples I to K the non-compressed portion is in particulate form. The non-compressed portion is then poured into the mould of the compressed and coated with a coating layer. For the purposes of Example L to N the non-compressed portion comprises a binding agent. The non-compressed portion is poured into the mould of the compressed portion and then subjected to a conditioning step, during which time the non-compressed portion hardens.

| | I | J | K | L | M | N |
|---|---|---|---|---|---|---|
| Compressed portion | | | | | | |
| STPP | 55.10 | 52.0 | 50.00 | 55.10 | 52.0 | 52.80 |
| Citrate | — | — | — | — | — | — |
| Carbonate | 14.0 | 16.0 | 18.40 | 14.0 | 6.0 | 15.40 |
| Silicate | 14.80 | 15.0 | 10.00 | 14.80 | 15.0 | 12.60 |
| Protease | — | — | — | — | — | — |
| Amylase | 0.75 | 0.75 | 2.0 | 0.75 | 0.75 | 0.95 |
| PB1 | 12.50 | 12.20 | 15.70 | 12.50 | 12.20 | 12.60 |
| PB4 | — | — | — | — | — | — |
| Nonionic | 1.5 | 1.50 | 0.80 | 1.5 | 1.50 | 1.65 |
| PAAC | 0.016 | 0.016 | — | 0.016 | 0.016 | 0.012 |
| TAED | — | — | 1.30 | — | — | — |
| HEDP | — | — | — | — | — | — |
| DETPMP | — | — | — | — | — | — |
| Paraffin | 0.50 | 0.5 | 0.50 | 0.50 | 0.5 | 0.55 |
| BTA | 0.30 | 0.3 | 0.33 | 0.30 | 0.3 | 0.33 |
| PA30 | — | — | — | — | — | — |
| Perfume | — | — | 0.20 | — | — | 0.05 |
| Sulphate | —2.00 | 10.68 | — | 2.00 | — | |
| Misc/water to balance | | | | | | |
| Weight (g) | 20.0 g | 20.0g | —20.0g | 22.0g | 20.0g | |
| Non-com- | | | | | | |

-continued

| pressed portion | | | | | | |
|---|---|---|---|---|---|---|
| Protease | 7.00 | 8.40 | 5.00 | — | 12.1 | 8.3 |
| Amylase | 6.80 | 5.00 | 9.30 | 15.00 | 12.4 | 10.00 |
| Bicarbonate | 16.00 | 18.00 | — | 12.1 | — | 15.00 |
| Citric acid | 12.30 | 15.00 | | 10.00 | | 12.50 |
| PEG 4000 | 4.00 | — | — | — | — | — |
| PEG 8000 | — | 5.50 | — | — | — | — |
| PVP | — | — | — | 8.00 | — | — |
| PEO | — | — | — | 2.00 | — | — |
| Sugar | — | — | 55.00 | — | 53.00 | — |
| Gelatine | — | — | 5.00 | — | 7.00 | — |
| Starch | — | — | 10.00 | — | — | — |
| Water | — | — | 10.00 | — | 10.00 | — |
| Triacetin | 42.00 | 45.00 | — | 51.00 | — | 45.00 |
| Thixatrol | | | | | | 5.00 |
| Misc./balance | | | | | | |
| Weight (g) | 2.5 g | 4.0 g | 2.5 g | 2.5 g | 3 g | 5.0 g |
| Coating Layer | | | | | | |
| Dodecandioic acid | 90.00 | 82.00 | — | — | — | — |
| Starch | 10.00 | 10.00 | — | — | — | — |
| PEG | — | — | 100 | — | — | — |
| Weight (g) | 1.00 | 1.00 | 0.5 | — | — | — |
| Total weight (g) of tablet | 23.5 g | 25 g | 23.0 g | 22.5 g | 25 g | 25 g |

What is claimed is:

1. A detergent tablet comprising a compressed portion and a non-compressed portion wherein:

a) said compressed portion comprises a mould and dissolves at a faster rate than said non-compressed portion on a weight by weight basis, measured using a SOTAX dissolution test method;

b) said non-compressed portion is in solid, gel or liquid form;

c) said non-compressed portion is delivered onto said mould of said compressed portion; and d) said non-compressed portion is partially retained within said mould; and wherein said non-compressed portion is affixed to said compressed portion by forming a coating over the non-compressed layer to secure it to the compressed portion or by hardening.

2. A detergent tablet according to claim 1 wherein the density of said non-compressed portion is at least 0.2 g/cm$^3$ less than the density of said compressed portion.

3. A detergent tablet according to claim 1 wherein said non-compressed portion is metasilicate-free.

4. A detergent tablet according to claim 1 wherein the non-compressed portion additionally comprises a finishing additive which is selected from the group consisting of organic polymeric compound, co-builder, enzyme, oxygen releasing bleach, bleach precursor or catalyst, surfactant, crystal growth inhibitor, and bleach-destroying agent.

5. A detergent tablet according to claim 1 wherein at least 60% of the compressed portion dissolves in deionized water at 50° C. within 12 minutes.

6. A detergent tablet according to claim 1 wherein at least 80% of the compressed portion dissolves in deionized water at 50° C. within 12 minutes.

7. A detergent tablet according to claim 1 wherein less than 40% of the non-compressed portion dissolves in deionized water at 50° C. within 12 minutes.

8. A detergent tablet according to claim 1 wherein less than 20% of the non-compressed portion dissolves in deionized water at 50° C. within 12 minutes.

9. A detergent tablet according to claim 1 wherein the non-compressed portion begins to dissolve after substantially all of the compressed portion has dissolved.

10. A detergent tablet according to claim 1 wherein said non-compressed portion comprises a finishing additive which is a fabric softener or a rinse aid.

11. A detergent tablet according to claim 10 wherein the fabric softener is a cationic fabric softening agent.

12. A detergent tablet according to claim 10 wherein the rinse aid comprises a nonionic surfactant.

13. A method for washing soiled articles in a washing machine having a washing cycle, comprising treating said articles with an aqueous liquid having dissolved or dispensed therein an effective amount of a detergent tablet according to claim 1, wherein at least 60% of the compressed portion dissolves within the first 12 minutes of the washing cycle and not more than 40% of the non-compressed portion dissolves in the washing cycle.

14. A method for washing soiled articles in a washing machine having a washing cycle and a rinsing cycle, comprising treating said articles with an aqueous liquid having dissolved or dispensed therein an effective amount of a detergent tablet according to claim 10, wherein more than 60% of the non-compressed portion dissolves in the rinsing cycle.

* * * * *